US011286785B2

(12) United States Patent
Hirata et al.

(10) Patent No.: US 11,286,785 B2
(45) Date of Patent: Mar. 29, 2022

(54) TURBINE ROTOR BLADE, TURBO MACHINE, AND CONTACT SURFACE MANUFACTURING METHOD

(71) Applicant: Mitsubishi Power Ltd., Kanagawa (JP)

(72) Inventors: Norifumi Hirata, Kanagawa (JP); Tetsuya Shimmyo, Kanagawa (JP); Satoshi Hada, Kanagawa (JP); Masamitsu Kuwabara, Kanagawa (JP); Shunsuke Torii, Kanagawa (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 0 days.

(21) Appl. No.: 17/252,534

(22) PCT Filed: Jun. 18, 2019

(86) PCT No.: PCT/JP2019/024156
§ 371 (c)(1),
(2) Date: Dec. 15, 2020

(87) PCT Pub. No.: WO2019/244900
PCT Pub. Date: Dec. 26, 2019

(65) Prior Publication Data

US 2021/0115800 A1 Apr. 22, 2021

(30) Foreign Application Priority Data

Jun. 19, 2018 (JP) ..... JP2018-116301

(51) Int. Cl.
*F01D 5/14* (2006.01)

(52) U.S. Cl.
CPC ..... *F01D 5/147* (2013.01); *F05D 2220/32* (2013.01); *F05D 2230/90* (2013.01); *F05D 2240/307* (2013.01)

(58) Field of Classification Search
CPC . F01D 5/22; F01D 5/288; F01D 5/225; F01D 5/147; F05D 2220/32; F05D 2230/90; F05D 2240/307
See application file for complete search history.

(56) References Cited

U.S. PATENT DOCUMENTS 6,164,916 A * 12/2000 Frost ..... F01D 5/288 416/189
9,963,980 B2 * 5/2018 Negri ..... F01D 5/288
(Continued)

FOREIGN PATENT DOCUMENTS

JP 2006-233857 9/2006
JP 2012-225207 11/2012
(Continued)

OTHER PUBLICATIONS

International Search Report dated Aug. 20, 2019 in International (PCT) Patent Application No. PCT/JP2019/024156.
(Continued)

*Primary Examiner* — Courtney D Heinle
*Assistant Examiner* — Andrew Thanh Bui
(74) *Attorney, Agent, or Firm* — Wenderoth, Lind & Ponack, L.L.P.

(57) ABSTRACT

A turbine rotor blade includes: a blade body including a pressure surface and a suction surface; and a tip shroud on a tip portion of the blade body, the tip shroud being inclined outward in a radial direction from the pressure surface to the suction surface in an axial direction. The tip shroud includes a fin at a center portion in a circumferential direction, the fin extending radially outward, a pressure-side tip shroud on the pressure surface side, and a suction-side tip shroud. The suction-side tip shroud includes a suction-side contact block at a front edge end of the tip shroud. The pressure-side tip shroud includes a pressure-side contact block at a rear edge end of the tip shroud, the suction-side contact block includes
(Continued)

a first surface facing in the circumferential direction, and the pressure-side contact block includes a second surface facing in a direction opposite to the circumferential direction.

21 Claims, 16 Drawing Sheets

(56) References Cited

U.S. PATENT DOCUMENTS

| | | | | |
|---|---|---|---|---|
| 10,598,030 | B2 * | 3/2020 | Kottilingam | B23K 35/0244 |
| 10,830,050 | B2 * | 11/2020 | Snider | F01D 5/143 |
| 2012/0195766 | A1 * | 8/2012 | Cohin | F01D 5/288<br>416/241 A |
| 2015/0345307 | A1 * | 12/2015 | Davidson | F01D 5/28<br>60/805 |
| 2017/0268350 | A1 | 9/2017 | Tabata et al. | |
| 2019/0309638 | A1 * | 10/2019 | Loisel | F01D 5/225 |

FOREIGN PATENT DOCUMENTS

| | | |
|---|---|---|
| JP | 2013-1923 | 1/2013 |
| WO | 2016/072473 | 5/2016 |

OTHER PUBLICATIONS

Written Opinion of the International Searching Authority dated Aug. 20, 2019 in International (PCT) Patent Application No. PCT/JP2019/024156, with English Translation.

* cited by examiner

TURBINE ROTOR BLADE, TURBO MACHINE, AND CONTACT SURFACE MANUFACTURING METHOD

TECHNICAL FIELD

The present invention relates to a turbine rotor blade, a plurality of the turbine rotor blades being disposed at predetermined intervals in a circumferential direction of a rotating shaft, a turbo machine provided with the turbine rotor blades, and a contact surface manufacturing method.

BACKGROUND ART

For example, a gas turbine for power generation, which is a type of turbo machine, is configured of a compressor, a combustor, and a turbine. Air taken in through an air inlet port is compressed by the compressor to obtain high-temperature and high-pressure compressed air, and fuel is supplied to the compressed air and combusted by the combustor to obtain high-temperature and high-pressure combustion gas (working fluid). The turbine is driven by the combustion gas, and a generator connected to the turbine is driven.

In the turbine of such gas turbine, the length in the blade height direction (radial direction in the rotating shaft) of first and second-stage rotor blades in the front stage is small, while the length in the blade height direction of third and fourth-stage rotor blades in the rear stage is large (long blade). Furthermore, since the turbine rotor blades that are long in the blade height direction are prone to vibrate, a tip shroud is mounted on a tip portion of each blade and the tip shrouds of adjacent blades are brought into contact with each other to form a ring-like shroud (see Patent Document 1).

CITATION LIST

Patent Document

Patent Document 1: JP 2012-225207A

SUMMARY OF INVENTION

Technical Problem

The contact surface of the tip shroud of the turbine rotor blade contacts the contact surface of the tip shroud of the adjacent turbine rotor blade. When they are in contact, deformation of the tip shroud during operation may cause partial contact on the contact surface, leading to damage to the contact surface. The damage to the contact surface of the tip shroud requires maintenance such as repair or replacement.

At least one embodiment of the present invention solves the problem described above, and an object of the present invention is to provide a turbine rotor blade, a turbo machine, and a contact surface manufacturing method that can reduce the possibility of damage to the contact surface, and can increase the reliability of the blade.

Solution to Problem

A turbine rotor blade according to at least one embodiment of the present disclosure for attaining the above-described object includes: a blade body including a pressure surface and a suction surface; and a tip shroud provided on a tip portion of the blade body, the tip shroud being inclined outward in a radial direction from the pressure surface to the suction surface in an axial direction, wherein the tip shroud includes a fin disposed at a center portion in a circumferential direction, the fin extending outward in the radial direction, a pressure-side tip shroud on the pressure surface side, and a suction-side tip shroud on the suction surface side.

The suction-side tip shroud includes a suction-side contact block at a front edge end of the tip shroud, the pressure-side tip shroud includes a pressure-side contact block at a rear edge end of the tip shroud, the suction-side contact block includes a first surface facing in the circumferential direction, the pressure-side contact block includes a second surface facing in a direction opposite to the circumferential direction which the first surface is facing, and a recessed portion is formed on at least an axial downstream end or a radial outer end of at least one of the first surface or the second surface.

Preferably, the first surface and the second surface of the adjacent blade in the circumferential direction are disposed so as to face each other.

Preferably, the suction-side shroud is configured of: the suction-side contact block; and a suction-side cover plate extending toward the axial downstream side of the fin from an edge of an axial inner circumferential surface of the tip shroud along the axial inner circumferential surface of the tip shroud so as to be away from the first surface. The pressure-side tip shroud is configured of: the pressure-side contact block; and a pressure-side cover plate extending toward the axial upstream side of the fin from the edge of the axial inner circumferential surface of the tip shroud along the axial inner circumferential surface of the tip shroud so as to be away from the second surface. In a circumferential sectional view enclosing the first surface or the second surface, the suction-side tip shroud extends toward the axial downstream side, and is inclined toward the radial outer side, and the pressure-side tip shroud extends toward the axial upstream side, and is inclined toward the radial inner side.

Preferably, when viewing a gap formed between the first surface and the second surface, an angle formed between the first surface and an inner circumferential surface facing a radial inner side of the suction-side tip shroud in a clockwise direction from the first surface is less than 90 degrees; and an angle formed between the second surface and an inner circumferential surface facing a radial inner side of the pressure-side tip shroud in a counterclockwise direction from the second surface is larger than 90 degrees.

Preferably, the recessed portion formed on the axial downstream end of the first surface or the second surface along a gap formed between the first surface and the second surface includes at least a radial outer end surface and an axial downstream end surface of the first surface or the second surface, and extends toward the radial inner side.

Preferably, the fin is coupled to the contact block or the cover plate via a fillet, and an axial upstream end of the recessed portion formed at the axial downstream end along a gap formed between the first surface and the second surface is formed between a position of an outer edge on the axial downstream side and a position of an outer edge on the axial upstream side of the fillet.

Preferably, the tip shroud includes: a suction-side end region provided at a front edge end, the suction-side end region having a fixed end on the blade body and extending from the fixed end to a suction-side cover end surface that is a free end on a front side in a rotational direction: and a pressure-side end region provided at a rear edge end, the pressure-side end region having a fixed end on the blade body and extending from the fixed end to a pressure-side cover end surface that is a free end on a rear side in the rotational direction.

Preferably, the recessed portion formed on the axial downstream end of the first surface or the second surface is inclined from an outer surface of an axial upstream end of the recessed portion toward the axial downstream end so as to retract from a contact surface in the circumferential direction.

Preferably, the recessed portion formed on the radial outer side of the first surface or the second surface is inclined from an outer surface of a radial inner end of the recessed portion toward the radial outer end so as to come closer to the fin.

Preferably, the suction-side contact block including the first surface is joined to the fin on an axial upstream side of the suction-side contact block, and is joined to a suction-side cover plate on an axial downstream side via an inclined surface; and the pressure-side contact block including the second surface is joined to the fin on an axial downstream side of the pressure-side contact block, and is joined to a pressure-side cover plate on an axial upstream side via an inclined surface.

A turbo machine according to the present disclosure for attaining the above-described object includes the turbine rotor blade described in any of the above.

A contact surface manufacturing method according to the present disclosure for attaining the above-described object is a method for manufacturing a contact surface, the contact surface being at least one of the first surface and the second surface of the turbine rotor blade described in any one of the above, the method including: forming a coating on a surface of a base material, the surface serving as the contact surface of the turbine rotor blade; polishing and flattening a surface of the formed coating; and polishing at least an axial downstream end or a radial outer end of the coating to form the recessed portion.

Advantageous Effects of Invention

According to at least one embodiment of the present invention, damage to the contact surface of the tip shroud is avoided and the reliability of the turbine rotor blade is improved.

DESCRIPTION OF EMBODIMENTS

Preferred embodiments of a turbine rotor blade, a turbo machine, and a contact surface manufacturing method according to the present invention will be described below in detail with reference to attached drawings. Note that the present invention is not limited to the embodiments.

First Embodiment

Figure 1:
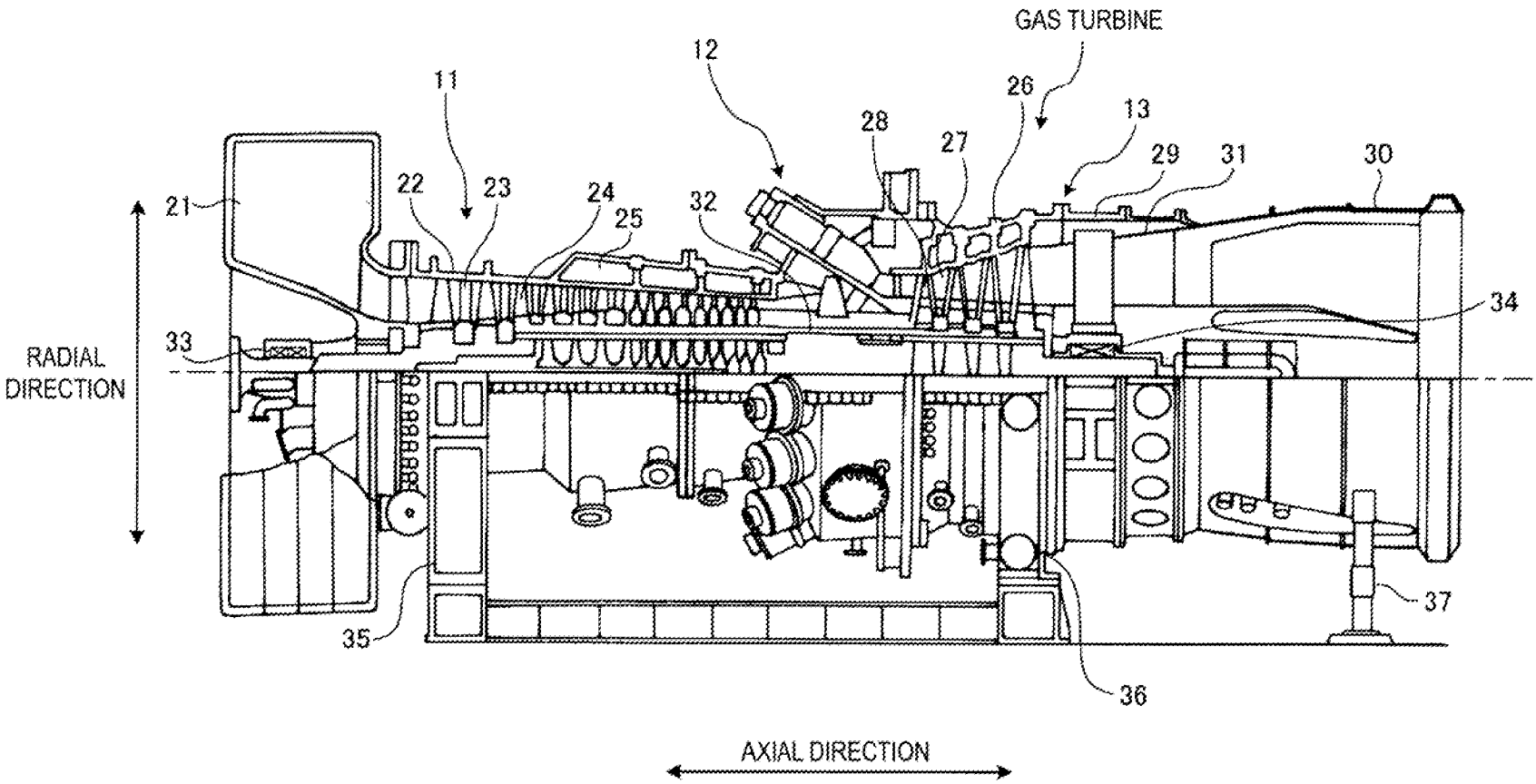
FIG. 1 is a schematic view illustrating a gas turbine to which turbine rotor blades according to a first embodiment are applied.
Figure 2:
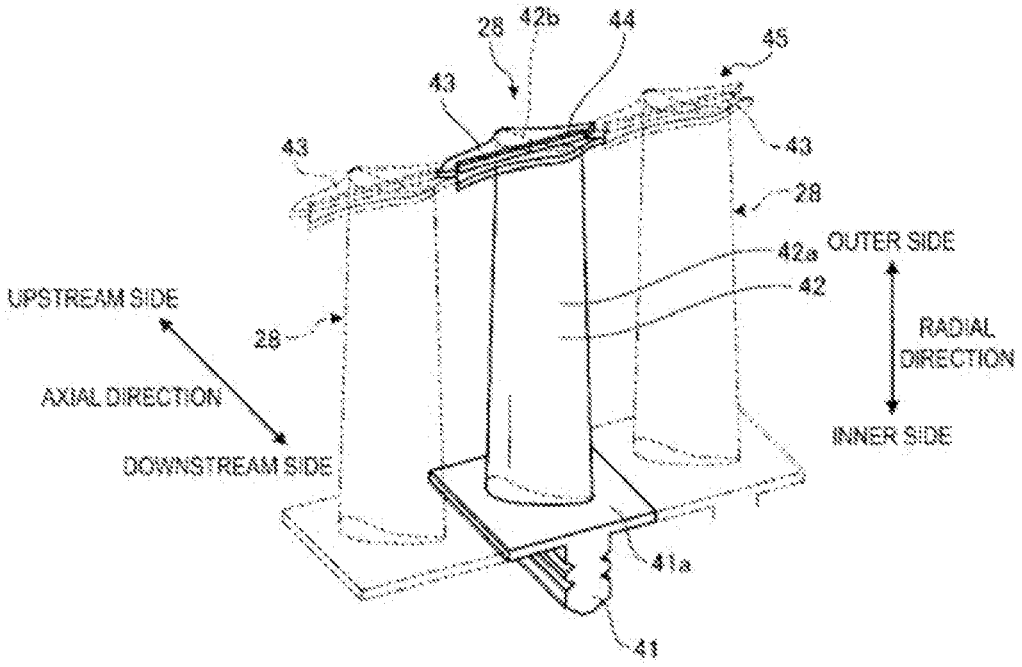
FIG. 2 is a schematic view illustrating the assembled state of the turbine rotor blade according to the first embodiment.

FIG. 1 is a schematic view illustrating a gas turbine to which turbine rotor blades according to a first embodiment are applied. FIG. 2 is a schematic view illustrating the assembled state of the turbine rotor blade according to the present embodiment. As illustrated in FIG. 1, a gas turbine according to the present embodiment is configured of a compressor 11, a combustor 12, and a turbine 13. The gas turbine is coupled to a power generator not illustrated in the drawings, and is capable of generating power.

The compressor 11 has an air inlet port 21 for taking in air. A plurality of vanes 23 and rotor blades 24 are alternately disposed in a compressor casing 22 in a forward/backward direction (axial direction of a rotor 32 described later), and an air bleed chamber 25 is provided on the outer side of the compressor casing. The combustor 12 supplies fuel to compressed air compressed by the compressor 11, and the mixture can be burned by ignition. In the turbine 13, a plurality of vanes 27 and rotor blades 28 are alternately disposed in a turbine casing 26 in the forward/backward direction (the axial direction of the rotor 32 described later). An exhaust chamber 30 is disposed downstream from the turbine casing 26 via an exhaust casing 29, and the exhaust chamber 30 includes an exhaust diffuser 31 connected to the turbine 13.

A rotor (rotating shaft) 32 is positioned so as to pass through the centers of the compressor 11, the combustor 12, the turbine 13, and the exhaust chamber 30. The end of the rotor 32 on the compressor 11 side is rotatably supported by a shaft bearing 33, and the end on the exhaust chamber 30 side is rotatably supported by a shaft bearing 34.

In the gas turbine, the compressor casing 22 of the compressor 11 is supported by a leg 35, the turbine casing 26 of the turbine 13 is supported by a leg 36, and the exhaust chamber 30 is supported by a leg 37.

Accordingly, air taken in through the air inlet port 21 of the compressor 11 passes through the plurality of vanes 23 and rotor blades 24 and is compressed, and the air is converted to high-temperature, high-pressure compressed air. A predetermined fuel is supplied to the compressed air in the combustor 12, causing the compressed air to burn. Then, the high-temperature, high-pressure combustion gas (working fluid), which is working fluid produced in the combustor 12, passes through the plurality of vanes 27 and rotor blades 28 that constitute the turbine 13, and rotationally drives the rotor 32, thereby driving the power generator coupled to the rotor 32. Meanwhile, energy from the exhaust gas (combustion gas) is converted to pressure by the exhaust diffuser 31 of the exhaust chamber 30 and decelerated, then discharged to the atmosphere.

In the above-described turbine 13 of the present embodiment, the rotor blade (turbine rotor blade) 28 on the side of the rear stage includes a tip shroud 43. As illustrated in FIG. 2, the rotor blade 28 includes a blade root 41 fixed to a disk (rotor 32), a blade body 42 having a bottom end joined to the blade root 41, the tip shroud 43 coupled to a tip portion of the blade body 42, and a seal fin (fin) 44 formed on an outer surface of the tip shroud 43 on the radial outer side. The blade body 42 includes a suction surface 42*a* and a pressure surface 42*b*. The suction surface 42*a* is a convex suction-side surface on which the exhaust gas flows in the planar cross section of the blade body 42. The pressure surface 42*b* is a concave pressure-side surface on which the exhaust gas flows in the planar cross section of the blade body 42. The blade body 42 is twisted at a predetermined angle. The plurality of blade roots 41 of the rotor blades 28 are fitted to the outer circumferential portion of the disc along the circumferential direction such that the tip shrouds 43 contact each other and are interconnected. In the turbine 13, the tip shrouds 43 of the plurality of rotor blades 28 are brought into contact with each other to constitute a ring-shaped shroud on the outer circumferential side in the radial direction.

Figure 5:
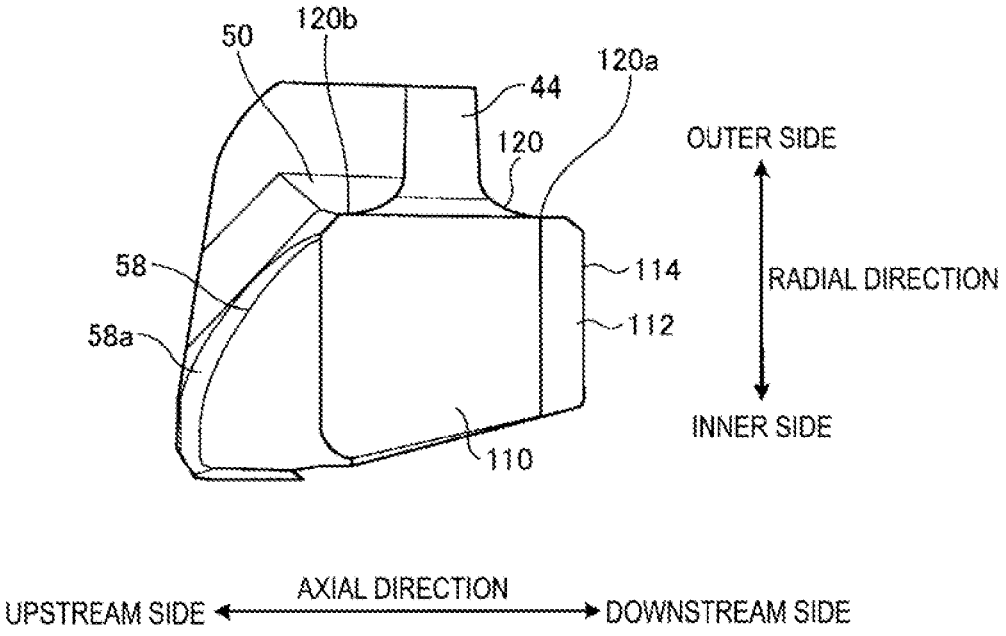
FIG. 5 is a front view illustrating a schematic configuration around a suction-side contact block in FIG. 3.
Figure 6:
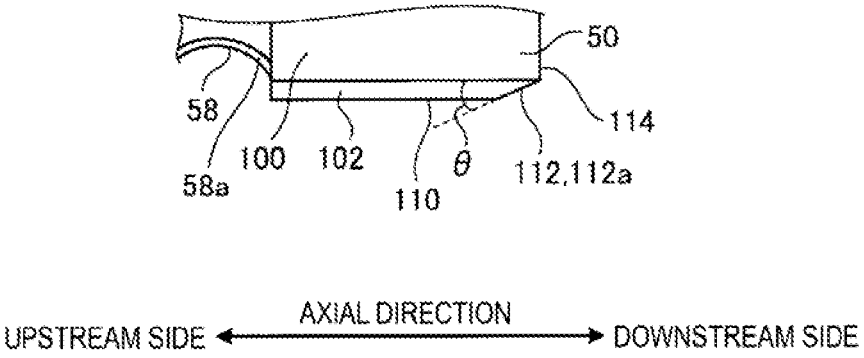
FIG. 6 is a top view illustrating the schematic configuration around the suction-side contact block in FIG. 3.
Figure 7:
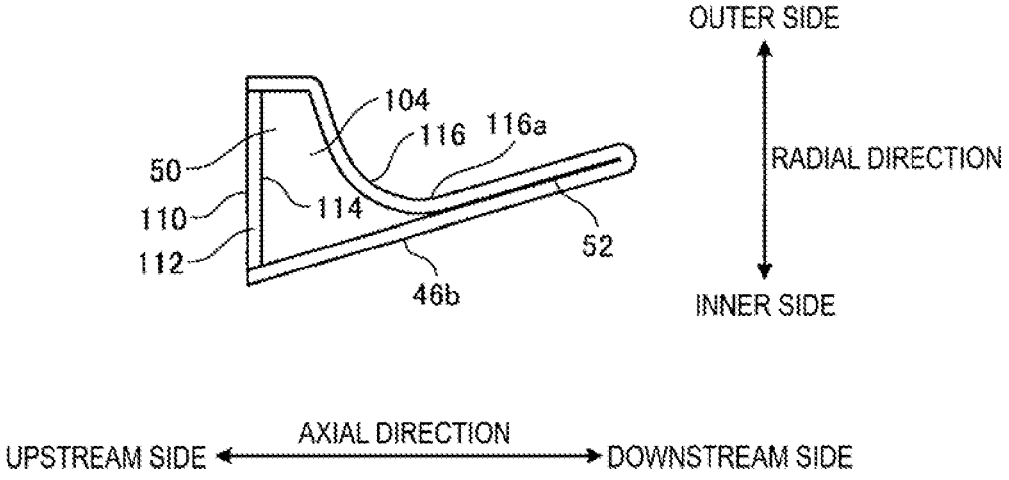
FIG. 7 is a side view illustrating the schematic configuration around the suction-side contact block in FIG. 3.
Figure 8:
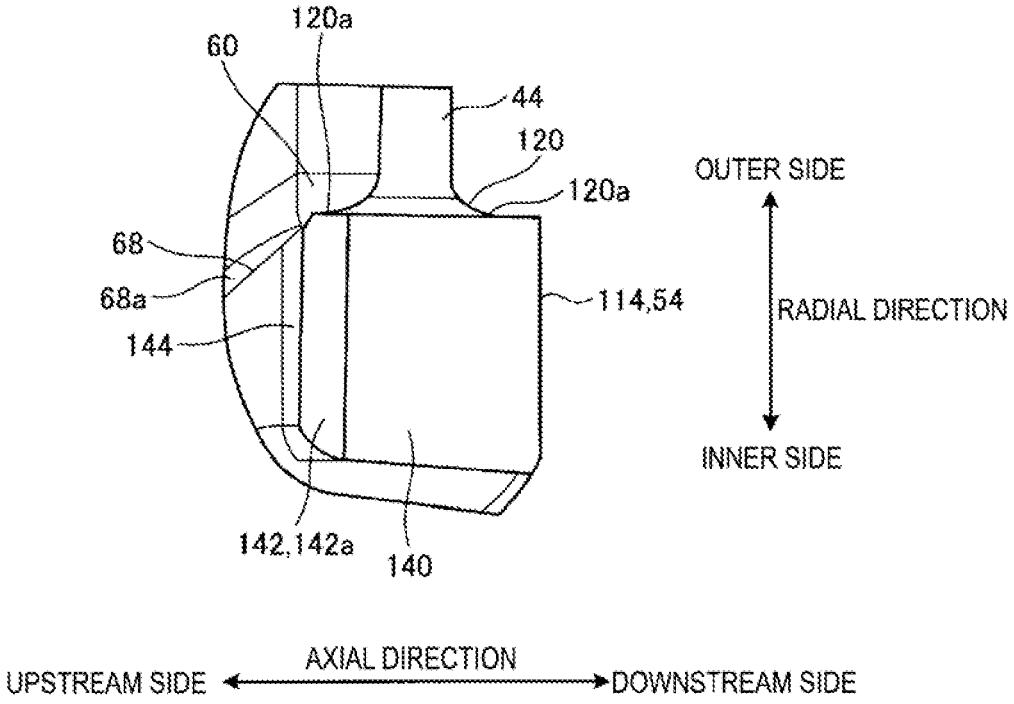
FIG. 8 is a front view illustrating the schematic configuration around the pressure-side contact block in FIG. 3.
Figure 9:
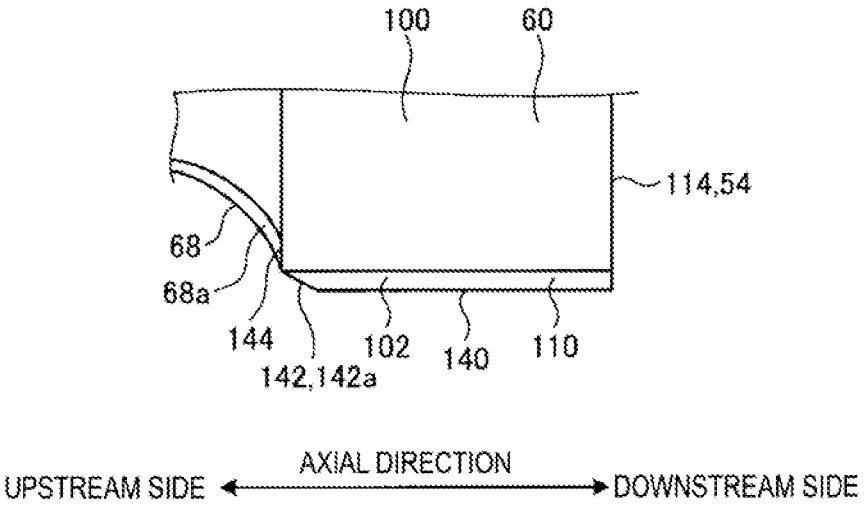
FIG. 9 is a top view illustrating the schematic configuration around the pressure-side contact block in FIG. 3.
Figure 10:
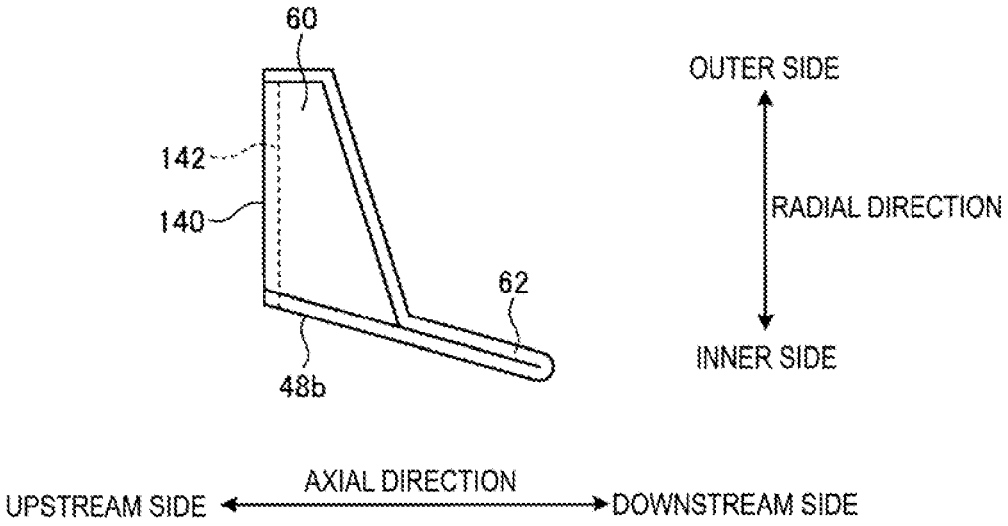
FIG. 10 is a side view illustrating the schematic configuration around the pressure-side contact block in FIG. 3.

Next, a detailed structure of the tip shroud 43 will be described with reference to FIGS. 4 to 10 in addition to FIG. 3. FIG. 4 is a schematic view illustrating an enlarged periphery of a contact portion of the tip shroud 43. FIG. 5 is a front view illustrating a schematic configuration of a suction-side contact block 50. FIG. 5 is a view when viewing the gap between the suction-side contact block 50 and a pressure-side contact block 60 from a direction A in FIG. 3. FIG. 6 is a top view illustrating the schematic configuration of the suction-side contact block 50. FIG. 7 is a side view illustrating the schematic configuration of the suction-side contact block 50. FIG. 7 is a view illustrating the suction-side contact block 50 when viewed from a direction B in FIG. 3. FIG. 8 is a front view illustrating the schematic configuration of the pressure-side contact block 60. FIG. 8 is a view illustrating the pressure-side contact block 60 when viewed from a direction C in FIG. 3. FIG. 9 is a top view illustrating the schematic configuration of the pressure-side contact block 60. FIG. 10 is a side view illustrating the schematic configuration of the pressure-side contact block 60. FIG. 10 is a view illustrating the pressure-side contact block 60 when viewed from a direction D in FIG. 3.

The tip shroud 43 has a long plate shape extending in the circumferential direction and is inclined outward in the radial direction from the pressure surface (pressure-side blade surface) to the suction surface (the suction-side blade surface) in the axial direction (see FIG. 9 in Patent Document 1). The tip shroud 43 includes a suction-side tip shroud 46 extending on the side of the suction surface 42*a* of the blade body 42, and a pressure-side tip shroud 48 extending on the side of the pressure surface 42*b* of the blade body 42. In the turbine rotor blade 28, the fin 44 extending outward in the radial direction is disposed on upper surfaces of the suction-side tip shroud 46 and the pressure-side tip shroud 48 on the radial outer side. The fin 44 is disposed at the center portion of the tip shroud 43 in the axial direction and extends in the circumferential direction of the turbine rotor blade 28. A fillet 120 is formed on a connecting portion of the fin 44 and the tip shroud 43. In other words, the fillet 120 of the fin 44 is formed as a concave plane of the connecting portion between axial upstream and downstream end surfaces 44*a* of the fin 44 on the radial outer side and an upper surface of the tip shroud 43 on the radial inner side, and an end of the fillet 120 formed on the upper surface of the tip shroud 43 forms a fillet outer edge 120*a*.

The suction-side tip shroud 46 includes a suction-side contact block 50 and a suction-side cover plate 51 extending from the fin 44 toward the axial downstream side. In addition, the suction-side cover plate 51 includes a downstream suction-side cover plate 52 formed on the side of the suction-side blade surface 42*a* on the axial downstream side with respect to the fin 44 and on the side of the suction-side contact block 50 on the front edge 42*c* side, and a downstream pressure-side cover plate 66 formed on the side of the pressure-side contact block 60 on the rear edge 42*d* side. The fin 44, the suction-side contact block 50, and the suction-side cover plate 51 are integrally formed to be a single piece. The suction-side cover plate 51 is a plate extending in an axial direction with respect to the radial direction in which the blade body 42 extends, and is bonded to the blade body 42 on the lower end surface of the suction-side cover plate 51 on the axial upstream side. Also, the suction-side cover plate 51 is coupled to the suction-side contact block 50 on the front edge 42*c* side of the top end surface on the axial upstream side, and the other portion of the suction-side cover plate 51 is coupled to the fin 44 via the fillet 120.

The suction-side contact block 50 is provided on a front edge end 43*a* of the suction-side tip shroud 46. The suction-side contact block 50 includes a suction-side contact surface (first surface) 110 that faces the front side in the rotational direction in the circumferential direction. As illustrated in FIG. 7, the suction-side contact block 50 has a structure having a thickness in the radial direction on the axial downstream side with respect to the suction-side contact surface 110, and an inclined surface outer edge 116*a* on the axial downstream side on the opposite side to the suction-side contact surface 110 in the axial direction is coupled to the downstream suction-side cover plate 52 to form a smooth surface. The suction-side contact block 50 has an inclined surface 116 such that an end on the side of the downstream suction-side cover plate 52 becomes gradually thinner in an axial direction toward the downstream suction-side cover plate 52. The inclined surface 116 is a concave inclined surface dented toward the radial inner side. The suction-side contact block 50 is an end of the suction-side contact surface 110 on the opposite side in the circumferential direction, is joined to the fin 44 on the axial upstream side, and is joined to the downstream suction-side cover plate 52 of the suction-side tip shroud 46 via the inclined surface 116 on the axial downstream side.

Figure 3:
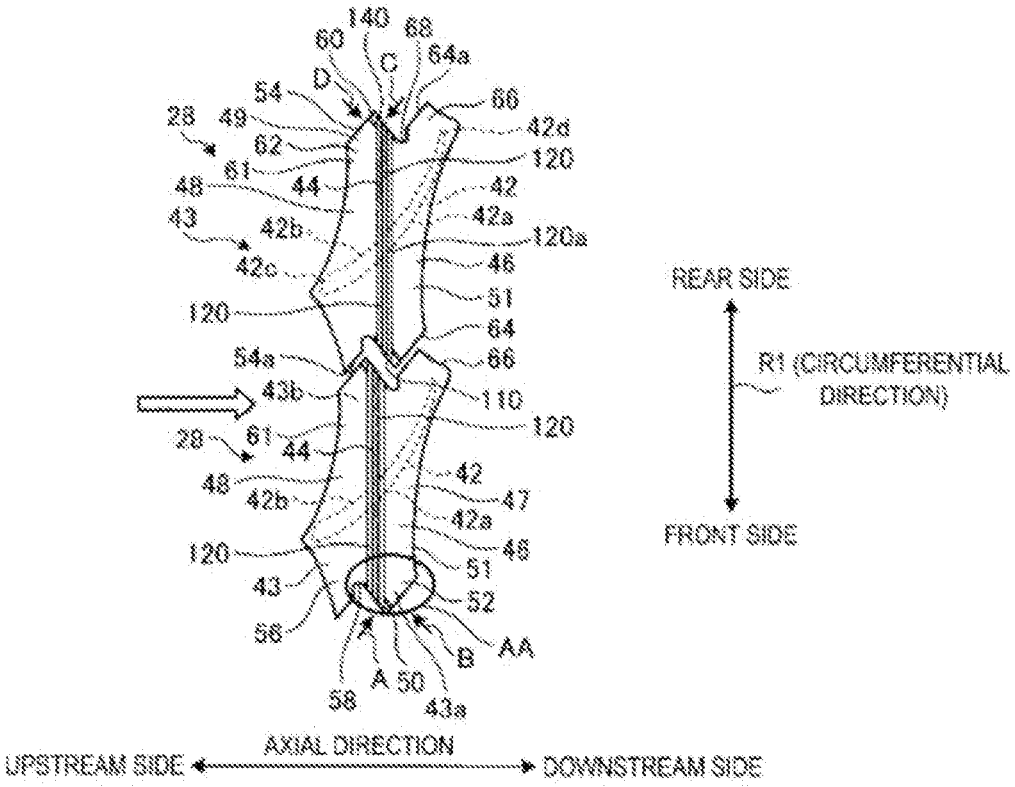
FIG. 3 is a schematic view illustrating a schematic configuration of a tip shroud of the turbine rotor blade according to the first embodiment.
Figure 4:
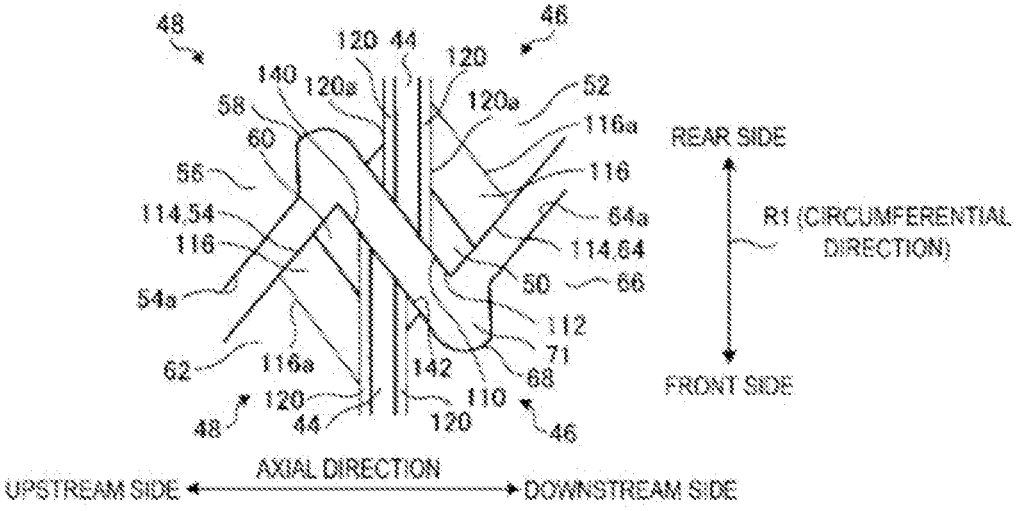
FIG. 4 is a schematic view illustrating an enlarged periphery of a contact portion of the tip shroud in FIG. 3.

As illustrated in FIG. 3 and FIG. 4, the suction-side contact surface 110 is a surface facing the pressure-side contact surface 140 of the pressure-side contact block 60 of the tip shroud 43 of adjacent turbine rotor blades described below in the circumferential direction. The downstream suction-side cover plate 52 extends from the suction-side blade surface 42*a* of the blade body 42 or the suction-side contact surface 110 along an inner circumferential surface 46*b* (FIG. 7) of the tip shroud 43 on the radial inner side so as to be away from the fin 44 on the axial downstream side. The downstream pressure-side cover plate 66 disposed opposite to the downstream suction-side cover plate 50 in the circumferential direction with respect to the blade body 42 is connected to an axial downstream end 60*b* of the pressure-side contact block 60 described below via the intermediate connecting portion 68. The intermediate connecting portion 68 is formed as a concave curved surface that forms a portion of the downstream pressure-side cover plate 66 and is recessed toward the pressure-side blade surface 42*b* of the blade body 42.

The pressure-side tip shroud 48 includes the pressure-side contact block 60 and a pressure-side cover plate 61 extending from the fin 44 toward the axial upstream side. In addition, the pressure-side cover plate 61 includes an upstream suction-side cover plate 56 formed on the side of the pressure-side blade surface 42*b* on the axial upstream side with respect to the fin 44 and on the side of the suction-side contact block 50 on the front edge 42*c* side, and an upstream pressure-side cover plate 62 formed on the side of the pressure-side contact block 60 on the rear edge 42*d* side. The fin 44, the pressure-side contact block 60, and the pressure-side cover plate 61 are integrally formed to be a single piece. In addition, a portion of the upstream pressure-side cover plate 62 of the pressure-side cover plate 61 is coupled to the pressure-side contact block 60 from the opposite side in the axial direction to the pressure-side contact surface 140 side of the pressure-side contact block 60 via the inclined surface 116. The other portion of the upstream pressure-side cover plate 62 is joined to the fin 44 via the fillet 120.

The pressure-side contact block 60 is provided at a rear edge end 43*b* of the pressure-side tip shroud 48. The pressure-side contact block 60 has a pressure-side contact surface (second surface) 140 that faces the rear side in the rotational direction in the circumferential direction. The pressure-side contact surface 140 is a surface facing the suction-side contact block 50 (suction-side contact surface 110) of the tip shroud 43 of the adjacent turbine rotor blade 28 in the circumferential direction and the axial direction. In other words, the pressure-side contact surface 140 is disposed so as to face the suction-side contact surface 110 of the adjacent turbine rotor blade 28 in the circumferential direction and the axial direction. The upstream pressure-side cover plate 62 is a plate-like member extending to radially intersect the blade body 42, and extends from the suction-side blade surface edge of the blade body 42 or the suction-side contact surface 110 along the direction separated from an inner circumferential surface 48*b* of the tip shroud 43 so as to be away from the axial upstream side. The upstream suction-side cover plate 56 is connected to the end of the suction-side contact block 50 on the axial upstream side via an intermediate connecting portion 58. The intermediate connecting portion 58 is formed as a convex curved surface that protrudes toward the suction-side blade surface of the blade body 42. Note that the suction-side contact surface (first surface) 110 and the pressure-side contact surface (second surface) are disposed parallel to each other.

Figure 11A:
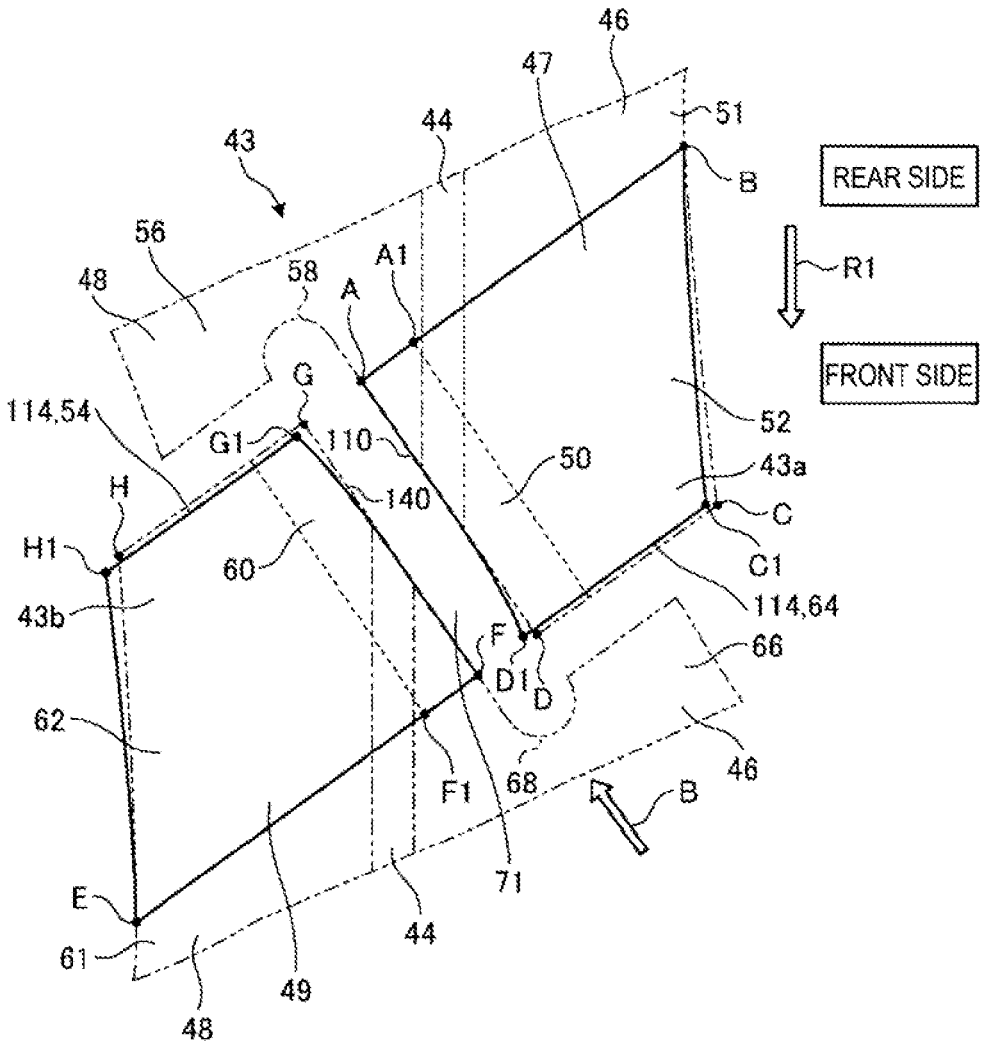
FIG. 11A is a top view illustrating the schematic configuration around the suction-side contact block and the pressure-side contact block.

As illustrated in FIG. 11A described later, in a pressure-side cover end surface 54 on the rear side in a rotational direction R1, the width of the upstream pressure-side cover plate 62 in the direction orthogonal to the pressure-side contact surface 140 is formed shorter than the width of the downstream suction-side cover plate 52 on the extension line of the pressure-side cover end surface 54 in the direction orthogonal to the suction-side contact surface 110. In other words, the width of the downstream suction-side cover plate 52 on the extension line of the pressure-side cover end surface 54 in the direction orthogonal to the suction-side contact surface 110 is formed longer than the width of the upstream pressure-side cover plate 62 along the pressure-side cover end surface 54 in the direction orthogonal to the pressure-side contact surface 140.

On the other hand, in a suction-side cover end surface 64 on the front side in the rotational direction R1, the width of the downstream suction-side cover plate 52 in the direction orthogonal to the suction-side contact surface 110 is formed shorter than the width of the upstream pressure-side cover plate 62 on the extension line of the suction-side cover end surface 64 in the direction orthogonal to the pressure-side contact surface 140. In other words, the width of the upstream pressure-side cover plate 62 on the extension line of the suction-side cover end surface 64 in the direction orthogonal to the pressure-side contact surface 140 is formed longer than the width of the downstream suction-side cover plate 52 along the suction-side cover end surface 64 in the direction orthogonal to the suction-side contact surface 110.

In addition, as illustrated in FIG. 3 and FIG. 4, to suppress leakage of combustion gas, the suction-side cover end surface 64 is disposed parallel to a downstream suction-side cover end surface 64*a* to maintain a predetermined gap 71 between the suction-side cover end surface 64 on the front side in the rotational direction R1 on the front edge 42*c* side and the downstream pressure-side cover plate 66 of the adjacent blade, disposed facing the suction-side cover end surface 64 in the circumferential direction. In other words, in the configuration of the blade, the suction-side cover end surface 64, which is disposed on the front side in the rotational direction R1 on the front edge 42*c* side and includes a contact block end 114 of the suction-side contact block 50, and the downstream pressure-side cover end surface 64*a* on the rear side in the rotational direction R1 and on the side of the suction-side cover plate 51 are arranged parallel to each other in the circumferential direction and the axial direction. Similarly, in the pressure-side cover plate 61 on the axial upstream side, the pressure-side cover end surface 54 on the rear side in the rotational direction R1 on the rear edge 42*d* side and an upstream suction-side cover end surface 54*a* of the front side suction-side cover plate 56 on the front edge 42*c* side in the rotational direction R1 are disposed parallel to each other in the circumferential direction and the axial direction.

Note that the end surface on the axial downstream side of the downstream suction-side cover plate 52 of the suction-side tip shroud 46 is located downstream from a throat position formed between the end surface and the adjacent turbine rotor blade 28. The upstream pressure-side cover plate 62 is connected to the end of the pressure-side contact block 60 on the axial downstream side via the intermediate connecting portion 68. The intermediate connecting portion 68 is a convex curved surface that protrudes toward the blade body 42. In addition, the intermediate connecting portions 58, 68 are formed as rigid curved planar wall portions 58*a*, 68*a* having respective smooth inclined surfaces from the radial outer side of the suction-side contact block 50 and the pressure-side contact block 60 toward the top surface of the pressure-side cover plate 61 or the suction-side cover plate 51 (FIG. 4).

Next, the structure of the suction-side contact surface 110 of the suction-side contact block 50 and the pressure-side contact surface 140 of the pressure-side contact block 60 will be described. As illustrated in FIGS. 3 and 4, the suction-side contact surface 110 faces the pressure-side contact surface 140 of the adjacent turbine rotor blade 28 in the circumferential direction and the axial direction.

In the suction-side contact surface 110 of the suction-side contact block 50, a coating 102 is formed on a base material 100. The coating 102 is a thermal-sprayed film and is formed from a material having a high wear resistance. Note that the material and the forming method of the coating 102 are not limited thereto. Furthermore, the coating 102 is preferably provided, but the surface of the base material 100 may be the suction-side contact surface 110 without providing the coating 102.

As illustrated in FIG. 3, FIG. 4, and FIGS. 11A and 11B, when the suction-side contact surface 110 is viewed from the axial upstream side, that is, the cross section of the suction-side tip shroud 46 is viewed from a direction in which the gap 71 formed between the suction-side contact surface 110 and the pressure-side contact surface 140 is viewed, the angle formed between the suction-side contact surface 110 and the inner circumferential surface 46*b* of the suction-side tip shroud 46, which faces the radial inner side, clockwise from the suction-side contact surface 110 is less than 90 degrees. In addition, in the circumferential cross-sectional view enclosing the suction-side contact surface 110 or the pressure-side contact surface 140, the suction-side contact surface 110 (the suction-side tip shroud 46) extends toward the axial downstream side and is inclined outward in the radial direction. The structural details of the suction-side contact block 50 including the suction-side contact surface 110 and the pressure-side contact block 60 including the pressure-side contact surface 140 will be described later.

The suction-side contact surface 110 is a flat surface and has a recessed portion 112 at an end on the axial downstream side. As illustrated in FIG. 5 and FIG. 6, the recessed portion 112 is formed at a position including a contact block end 114 on the opposite side to the intermediate connecting portion 58 of the suction-side contact surface 110. A recessed portion inclined surface 112*a* having an inclination angle θ is formed so as to retract toward the rear edge 42*d* on the rear side in the rotational direction R1 with respect to the flat suction-side contact surface 110 as it extends toward the contact block end 114 of the suction-side contact block 50. The recessed portion 112 is formed in the radial entire range of the suction-side contact surface 110, that is, from the radial upper end thereof to the radial lower end thereof.

Preferably, the axial upstream end of the recessed portion 112 is formed on the axial upstream side with respect to the position of the fillet outer edge 120*a* of the fillet 120 on the axial downstream side. More preferably, the recessed portion 112 is axially formed in the region where the fillet 120 is formed, that is, located at the fillet outer edge 120*a* of the fillet 120 on the axial upstream side. When the recessed portion 112 is formed in the region described above, the position where the suction-side contact surface 110 and the pressure-side contact surface 140 contact each other can be set to the base of the fin 44 having a high rigidity, and a lack of surface pressure due to a decrease in the contact area of the contact surface can be avoided. Note that the recessed portion 112 need not be an inclined surface such as the recessed portion inclined surface 112*a*, and may have a shape recessed toward the rear side in the rotational direction in the circumferential direction with respect to the flat surface 102*a*.

As illustrated in FIG. 6, in the suction-side contact surface 110 of the suction-side contact block 50, the coating 102 is formed on the base material 100. The coating 102 is a thermal-sprayed film and is formed from a material having a high wear resistance. Note that the material and the forming method of the coating 102 are not limited thereto. Furthermore, the coating 102 is preferably provided, but the surface of the base material 100 may be the suction-side contact surface 110 without providing the coating 102.

Figure 11B:
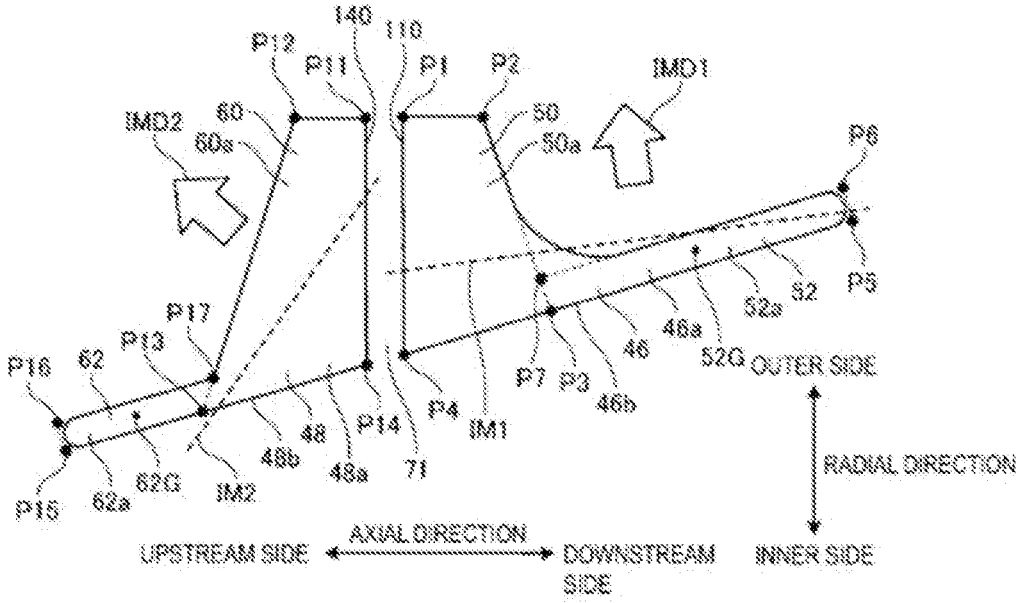
FIG. 11B is a side view illustrating a combination of the suction-side contact block and the pressure-side contact block.

As illustrated in FIG. 8, FIG. 9, and FIG. 11B, when the pressure-side contact surface 140 is viewed from the axial upstream side, that is, the cross section of the pressure-side tip shroud 48 is viewed from a direction in which the gap 71 formed between the suction-side contact surface 110 and the pressure-side contact surface 140 is viewed, the angle formed between the pressure-side contact surface 140 and the inner circumferential surface 48*b* of the pressure-side tip shroud 48, which faces the radial inner side, clockwise from the pressure-side contact surface 140 is larger than a right angle (90 degrees). In the circumferential cross-sectional view enclosing the suction-side contact surface 110 or the pressure-side contact surface 140, the pressure-side contact surface 140 (the pressure-side tip shroud 48) extends toward the axial upstream side and is inclined toward the radial inner side.

The pressure-side contact surface 140 is a flat surface and has a recessed portion 142 at an end on the axial downstream side. The recessed portion 142 is formed at a position including a contact block end 144 connected to the intermediate connecting portion 58 of the pressure-side contact surface 140. A recessed portion inclined surface 142*a* is inclined so as to retract toward the front edge 42*c* on the front side in the rotational direction R1 with respect to the flat pressure-side contact surface 140 as it extends toward the contact block end 144 of the pressure-side contact block 60. The recessed portion 142 is formed in the radial entire range of the pressure-side contact surface 140, that is, from the radial upper end thereof to the radial lower end thereof. The preferred position of the recessed portion 142 of the pressure-side contact block 60 with respect to the fillet 120 of the fin 44 is the same as the preferred position of the recessed portion 112 of the suction-side contact block 50.

The turbine rotor blade 28 receives a centrifugal force generated by rotation of the turbine 13. While the tip shroud 43 is radially deformed by a centrifugal force F, the suction-side contact block 50 contacts the pressure-side contact block 60 of the adjacent turbine rotor blade 28 on one side in the circumferential direction, and the pressure-side contact block 60 contacts the suction-side contact block 50 of the adjacent turbine rotor blade 28 on the other side in the circumferential direction. In other words, the pressure-side contact surface 140 of the tip shroud 43 of the turbine rotor blade 28 and the suction-side contact surface 110 of the tip shroud 43 of the adjacent turbine rotor blade 28 in the circumferential direction easily contact with each other.

As an example, the reason for partial contact of the suction-side contact surface 110 of the suction-side contact block 50 of the suction-side tip shroud 46 of the turbine rotor blade 28 with the pressure-side contact surface 140 of the pressure-side contact block 60 of the pressure-side tip shroud 48 of the adjacent turbine rotor blades 28 facing the turbine blade 28 in the circumferential direction will be described below with reference to FIGS. 11A to 11C.

The structure around the suction-side contact block 50 and the pressure-side connector block 60 having the opposing suction-side contact surface 110 and pressure-side contact surface 140, respectively, will be described below with reference to FIG. 11A. FIG. 11A is an enlarged top view illustrating AA that is a combination of portions A and B illustrated in FIG. 3, in which the suction-side contact surface 110 and the pressure-side contact surface 140 are disposed so as to face each other in the circumferential direction. In other words, this figure is a schematic view illustrating the structure of the suction-side contact block 50 and the pressure-side connector block 60 that are disposed so as to face each other in the circumferential direction, when the tip shroud 43 is viewed from the radial outer side to the radial inner side. In addition, FIG. 11A illustrates a trapezoidal suction-side end region 47 that is provided on the suction-side tip shroud 46 and represented by two-dot chain line surrounded by points A, B, C, and D, and a trapezoidal pressure-side end region 49 that is provided on the pressure-side tip shroud 48 and represented by a two-dot chain line surrounded by points E, F, G, and H.

The suction-side end region 47 is disposed at the front edge end 43*a* of the tip shroud 43 on the front side in the rotational direction R1 and includes the fin 44, the suction-side contact block 50, and the downstream suction-side cover plate 52. The suction-side contact block 50, the fin 44, and the downstream suction-side cover plate 52 are arranged in the order from the axial upstream side to the axial downstream side, and are integrally formed into a single piece. Note that in the suction-side end region 47, a side AB is joined to a high-rigidity region of the tip shroud 43 near the blade body 42, and a side BC, a side CD, and a side AD are not constrained in any way from other members, and are freely displaceable ends (free ends). Accordingly, the suction-side end region 47 can be recognized as a simple model as a trapezoidal cantilever ABCD having the side AB as the fixed end and the side CD as the free end. The circumferential position of the side AB that is the fixed end roughly coincides with a side AA 1 of the end surface that faces the rear side in the rotational direction R1 of the suction-side contact block 50, which is more rigid than the downstream suction-side cover plate 52. Accordingly, the side AB that is the fixed end is less deformable than the side CD that is the free end. The side AB is disposed on an extension line of a side GH of the pressure-side end region 49 disposed adjacent in the axial direction. The length of the side AB, which is the fixed end of the cantilever ABCD, is longer than the length of the side CD, which is the free end.

The pressure-side end region 49 is disposed at the rear edge end 43*b* of the tip shroud 43 on the rear side in the rotational direction R1 and includes the fin 44, the pressure-side contact block 60, and the upstream pressure-side cover plate 62. The pressure-side contact block 60, the fin 44, and the upstream pressure-side cover plate 62 are arranged in the order from the axial downstream side to the axial upstream side, and are integrally formed into a single piece. In the pressure-side end region 49, a side EF is joined to a high-rigidity region of the tip shroud 43 near the blade body 42 on the front side in the rotational direction R1, and a side FG, a side GH, and a side EH are not constrained in any way from other members, and are freely displaceable ends (free ends). Accordingly, the pressure-side end region 49 can be recognized as a simple model as a trapezoidal cantilever EFGH having the side EF as the fixed end. The position of the side EF in the circumferential direction that is the fixed end roughly coincides with a side FF 1 of the end surface that faces of the contact block 60 on the front side in the rotational direction R1, and is disposed on an extension line of the side CD of the adjacent suction-side end region 47 in the axial direction. The length of the side EF, which is the fixed end of the cantilever EFGH, is longer than the length of the side GH, which is the free end.

FIG. 11B is a cross-sectional view taken from the direction B illustrated in FIG. 3 and FIG. 11A, wherein the suction-side tip shroud 46 and the pressure-side tip shroud 48 are disposed such that the suction-side contact surface 110 faces the pressure-side contact surface 140 with the gap 71 formed between the suction-side contact surface 110 of the suction-side tip shroud 46 and the pressure-side contact surface 140 of the pressure-side tip shroud 48. FIG. 11B is a cross-sectional view illustrating the combination of the suction-side end region 47 and the pressure-side end region 49 when viewed from the direction B. FIG. 11B illustrates a simple model of the structure of the suction-side tip shroud 46 and the pressure-side tip shroud 48. In other words. FIG. 11B illustrates the suction-side tip shroud 46 in a simplified cross section of combined two cross sections: a cross section 50*a* of the suction-side contact block 50, which is indicated as a deformed rectangular cross section surrounded by points P1, P2, P3, and P4, and a cross section 52*a* of the downstream suction-side cover plate 52, which is indicated as a deformed rectangular cross section surrounded by the points P3, P5, P6, and P7. The cross section 52*a* of the downstream suction-side cover plate 52 is indicated as the deformed rectangle that extends away from the suction-side contact surface 110 from the axial upstream side toward the axial downstream side to be separated from the suction-side contact surface 110, and is inclined upward in the radial outward direction. The pressure-side tip shroud 48 is illustrated in a simplified cross section of combined two cross sections: a cross section 60*a* of the pressure-side contact block, which is indicated as a deformed rectangular cross section surrounded by points P11, P12, P13, and P14, and a cross section 62*a* of the upstream pressure-side cover plate 62, which is indicated as a deformed rectangular cross section surrounded by the points P13, P15, P16, and P17. The cross section 62*a* of the upstream pressure-side cover plate 62 is indicated as the deformed rectangle that extends away from the pressure-side contact surface 140 from the axial downstream side toward the axial upstream side to be separated from the pressure-side contact surface 140, and is inclined upward in the radial inward direction.

The ease of deformation and the direction of deformation of each cross section due to a difference in cross-sectional shape between a cross section 46*a* of the suction-side tip shroud 46 and a cross section 48*a* of the pressure-side tip shroud 48 will be described below. As illustrated in FIG. 11B, the cross section 50*a* of the suction-side contact block 50, which forms a part of the cross section 46*a* of the suction-side tip shroud 46, is a radially extending deformed rectangular cross section, while the cross section 52*a* of the downstream suction-side cover plate 52 is a deformed rectangular cross section that is inclined upward on the radial outer side along the inner circumferential surface 46*b* of the suction-side tip shroud 46 on the radial inner side and extends in the axial downstream direction.

The cross section 60*a* of the pressure-side contact block, which forms the cross section 48*a* of the pressure-side tip shroud 48, is a radially extending deformed rectangular cross section, while the cross section 62*a* of the upstream pressure-side cover plate 62 is a deformed rectangular cross section that is inclined downward on the radial inner side along the inner circumferential surface 48*b* of the pressure-side tip shroud 48 on the radial inner side and extends in the axial upstream direction.

Due to the above-described difference, when the tip shroud 43 of the turbine rotor blade 28 receives the centrifugal force F, the direction of deformation of the cross section 46*a* of the suction-side tip shroud 46 is different from the direction of deformation of the cross section 48*a* of the pressure-side tip shroud 48. In other words, given that a main axis of the smallest cross-sectional secondary moment of the cross section 46*a* of the suction-side tip shroud 46 is IM1 indicated by a dashed line, and a direction orthogonal to the main axis IM1 is IMD1 indicated by an arrow, the direction indicated by IMD1 is the direction in which the cross section 46*a* of the suction-side tip shroud 46 receives to the centrifugal force F, is most susceptible to deformation, and is deformed the most. Given that a main axis of the smallest cross-sectional secondary moment of the cross section 48*a* of the pressure-side tip shroud 48 is IM2 indicated by a dashed line, and a direction orthogonal to the main axis IM2 is IMD2 indicated by an arrow, the direction indicated by the IMD2 is the direction in which the cross section 48*a* of the pressure-side tip shroud 48 receives to the centrifugal force F, is most susceptible to deformation, and is deformed the most. The direction IMD1 in which the cross section 46*a* of the suction-side tip shroud 46 is deformed is a direction that is more inclined toward the pressure-side contact surface 140 than the radial outer direction (the direction orthogonal to the rotor 32), and comes closer to the pressure-side contact surface 140 of the adjacent blade. This is due to that the extending direction of the downstream suction-side cover plate 52 joined to the cross section 50*a* of the radially extending suction-side contact block 50 is the upward direction on the radial outer side. The direction IMD2 in which the cross section 48*a* of the pressure-side tip shroud 48 is deformed is a direction that is away from the suction-side contact surface 110 of the adjacent blade and is further inclined toward the axial upstream side than the direction IMD1 in which the cross section 46*a* of the suction-side tip shroud 46 is deformed. This is due to that the extending direction of the upstream pressure-side cover plate 62 joined to the cross section 60*a* of the radially extending pressure-side contact block is the downward direction on the radial inner side. As a result, the suction-side tip shroud 46 and the pressure-side tip shroud 48 receive the centrifugal force F, such that the suction-side contact surface 110 and the pressure-side contact surface 140 of adjacent blades are deformed to be away from each other.

Next, with reference to FIG. 11A, the relative movement of the suction-side contact surface 110 and the pressure-side contact surface 140 of the adjacent blade in the circumferential direction when the tip shroud 43 is viewed from the radial outer side toward the radial inner side will be described. In the suction-side end region 47 simplified as the cantilever ABCD and the pressure-side end region 49 simplified as the cantilever EFGH of the adjacent blade in the circumferential direction, the side AB and the side EF that are the fixed ends are disposed opposite to the side CD and the side GH that are the free ends, respectively, in the rotational direction R1. In other words, in the suction-side end region 47, the side AB that is the fixed end is disposed on the rear side in the rotational direction R1, and the side CD that is the free end is disposed on the front side in the rotational direction R1. In the pressure-side end region 49 of adjacent blade in the circumferential direction, the side EF that is the fixed end is disposed on the front side in the rotational direction R1, and the side GH that is the free end is disposed on the rear side in the rotational direction R1. The suction-side end region 47 and the pressure-side end region 49 are disposed to face in opposite directions to each other in the rotational direction R1. Note that when viewed in units of blades, as illustrated in FIG. 3, the suction-side end region 47 is disposed on the front edge end 43*a* on the front side in the rotational direction R1 with respect to the blade body 42, and the pressure-side end region 49 is disposed on the rear edge end 43*b* on the rear side in the rotational direction R1 with respect to the blade body 42. That is, the side AB that is the fixed end of the suction-side end region 47 and the side EF that is the fixed end of the pressure-side end region 49 are disposed on the front side and the rear side in the rotational direction R1 via the blade body 42, and the suction-side end region 47 extends from the side AB that is the fixed end to the side CD that is the free end on the front side in the rotational direction R1. The pressure-side end region 49 extends from the side EF that is the fixed end to the side GH that is the free end on the rear side in the rotational direction R1. Accordingly, the side CD and the GH that are the free ends are disposed opposite to the side AB and the side EF that are the fixed ends in the circumferential direction (rotational direction R1). The length of the suction-side end region 47 in the rotational direction (the length of the side AD of the cantilever ABCD along the gap 71) is approximately the same as the length in the rotational direction of the pressure-side end region 49 (the length of the side FG of the cantilever EFGH along the gap 71).

As described above, in the positional relationship between the suction-side end region 47 and the pressure-side end region 49 adjacent to each other via the suction-side contact surface 110 and the pressure-side contact surface 140, the shapes of the cantilever ABCD and the cantilever EFGH after deformation outward in the radial direction in response to the centrifugal force F are indicated as a cantilever ABC1D1 and a cantilever EFG1H1. That is, the side AB that is the fixed end of the cantilever ABCD is hardly deformed and moved by the centrifugal force F. On the other hand, as described above, the direction IMD1 is the direction in which the cross section 46*a* of the suction-side tip shroud 46 is deformed and is the direction that comes closer to the pressure-side contact surface 140. Accordingly, the side CD that is the free end moves toward the pressure-side contact surface 140 of the adjacent blade. The position of the moved side CD is indicated as a side C1D1. After the displacement of the side CD, the point D that is the tip portion of the suction-side contact surface 110 closest to the pressure-side connector surface 140 moves to the point D1, and the suction-side contact surface 110 comes closer to the pressure-side contact surface 140. Finally, in the vicinity of the point D of the suction-side contact surface 110 that is the tip portion on the front side (axial downstream side) of the cantilever ABCD in the rotational direction R1, the suction-side contact surface 110 may partially contact the pressure-side contact surface 140.

On the other hand, as described above, the direction IMD2 in which the cross section 48*a* of the pressure-side tip shroud 48 is deformed is the direction away from the suction-side contact surface 110. Thus, the cantilever EFGH on the side of the pressure-side contact surface 140 disposed facing the suction-side contact surface 110 receives the centrifugal force F such that the side GH that is the free end moves away from the suction-side contact surface 110. However, the position of the point A on the side of the suction-side contact surface 110, which faces the point G near the free end of the pressure-side contact surface 140 closest to the suction-side contact surface 110 in the axial direction is a part of the fixed end that forms the cantilever ABCD and hardly moves in response to the centrifugal force F. Thus, there is no possibility that the point A of the cantilever ABCD on the suction-side contact surface 110 and the point G of the cantilever EFGH on the pressure-side contact surface 140 contact each other under the centrifugal force F. Note that in FIG. 11A, the blade shape in a stationary state is indicated by a two-dot chain line, and the deformed blade shape in the operating state is indicated by a solid line.

Figure 11C:
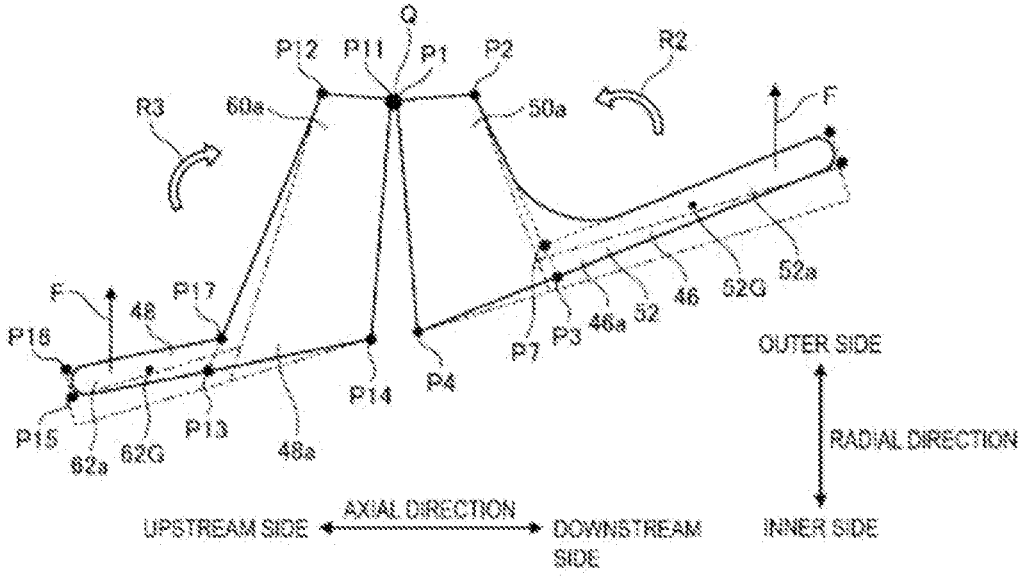
FIG. 11C is another side view illustrating a combination of the suction-side contact block and the pressure-side contact block.

As illustrated in FIG. 11C, the suction-side tip shroud 46 and the pressure-side tip shroud 48 receive the centrifugal force F and undergo torsional deformation in response to the rotational force in opposite directions, such that the suction-side contact surface 110 and the pressure-side contact surface 140 contact each other at the upper ends of the opposing contact surfaces. In other words, as illustrated in FIG. 11C, the cross section 46*a* of the suction-side tip shroud 46 receives the centrifugal force F and rotates in a counterclockwise direction R2 on the sheet in FIG. 11C. On the other hand, the cross section 48*a* of the pressure-side tip shroud 48 receives the centrifugal force F and rotates in a clockwise direction R3. The reason for this will be described below.

As illustrated in FIG. 11B, the cross section 46*a* of the suction-side tip shroud 46 can be indicated as a combined cross section of the cross section 50*a* (deformed rectangular cross section P1P2P3P4) of the suction-side contact block 50 and the cross section 52*a* (deformed rectangular cross section P3P5P6P7) of the downstream suction-side cover plate. The cross section 50*a* of the suction-side contact block 50 is a radially extending rectangular cross section having a large axial width and a high rigidity. Thus, the cross section 50*a* itself of the suction-side contact block 50 hardly undergoes torsional deformation due to rotation upon receiving the centrifugal force F. On the other hand, the cross section 52*a* of the downstream suction-side cover plate 52 is a thin elongated rectangular cross section extending in the axial downstream direction, and the position of a cross-sectional center 52G of the cross section 52*a* of the downstream suction-side cover plate 52 is separated downstream from the cross section 50*a* of the suction-side contact block 50 in the axial direction. Accordingly, the cross section 52*a* of the downstream suction-side cover plate 52 is deformed in the radial outward direction in response to the centrifugal force F, and is flipped up outward in the radial direction. At a position (side P3P7) at which the cross section 50*a* of the suction-side contact block 50 is joined to the cross section 52*a* of the downstream suction-side cover plate 52, the suction-side contact block 50 rotates in the counterclockwise direction R2 due to the rotational moment received by the cross section 50*a* of the suction-side contact block 50 from the cross section 52*a* of the downstream suction-side cover plate 52 under the centrifugal force F, resulting in torsional deformation.

Similarly, as illustrated in FIG. 11B, the cross section 48*a* of the pressure-side tip shroud 48 can be indicated as a combined cross section of the cross section 60*a* (deformed rectangular cross section P11P12P13P14) of the pressure-side contact block 60 and the cross section 62*a* (deformed rectangular cross section P13P15P16P17) of the upstream pressure-side cover plate 62. The cross section 60*a* of the pressure-side contact block is a radially extending deformed rectangular cross section having a large axial width and a high rigidity. Thus, the cross section 60*a* itself of the pressure-side contact block 60 hardly undergoes torsional deformation due to rotation upon receiving the centrifugal force F. On the other hand, the cross section 62*a* of the upstream pressure-side cover plate 62 is a thin elongated rectangular cross section extending in the axial upstream direction, and the position of a cross-sectional center 62G of the cross section 62*a* is separated upstream from the cross section 60*a* of the pressure-side contact block in the axial direction. Accordingly, the cross section 62*a* of the upstream pressure-side cover plate 62 is deformed in the radial outward direction in response to the centrifugal force F, and is flipped up outward in the radial direction. At a position (side P13P17) at which the cross section 60*a* of the pressure-side contact block 60 is joined to the cross section 62*a* of the upstream pressure-side cover plate 62, the pressure-side contact block 60 rotates in the counterclockwise direction R3 due to the rotational moment received by the cross section 60*a* of the pressure-side contact block 60 from the cross section 62*a* of the upstream pressure-side cover plate 62 under the centrifugal force F, resulting in torsional deformation.

In FIG. 11C, the rotational directions of the suction-side tip shroud 46 and the pressure-side tip shroud 48 in response to the centrifugal force F are indicated as the arrows R2, R3. When the centrifugal force F acts on the cross section 46*a* of the suction-side tip shroud 46 and the cross section 48*a* of the pressure-side tip shroud 48, the cross section 46*a* of the suction-side tip shroud 46 rotates in the counterclockwise direction R2, and the cross section 48*a* of the pressure-side tip shroud 48 rotates in the clockwise direction R3. Therefore, when the centrifugal force F acts on the tip shroud 43, the radial outer end of the suction-side contact surface 110 of the suction-side tip shroud 46 (point P1 on the cross section 50*a* of the suction-side contact block 50) and the radial outer end of the pressure-side contact surface 140 of the pressure-side tip shroud 48 (point P11 on the cross section 60*a* of the pressure-side contact block 60) partially contact each other at a point Q. and the suction-side tip shroud 46 and the pressure-side tip shroud 48 rotate about the point Q in the opposing directions indicated as the arrow R2 and the arrow R3. Note that in FIG. 11C, the cross-sectional shape of the tip shroud 43 in the stationary state is indicated by a two-dot chain line, and the cross-sectional shape of the tip shroud 43 in the operating rotational state under the centrifugal force F is indicated by a solid line.

As described with reference to FIGS. 11A to 11C, the cross section 46*a* of the suction-side tip shroud 46 and the cross section 48*a* of the pressure-side tip shroud 48 face each other via the suction-side contact surface 110 and the pressure-side contact surface 140, and these cross sections have different shapes. As a result, the suction-side contact surface 110 and the pressure-side contact surface 140 may partially contact each other and be damaged. For this reason, it is required to avoid damage caused by contact and to take measures for improving the reliability of the turbine rotor blade, and it is important to provide the recessed portions 112, 142 at proper positions of the suction-side contact surface 110 and the pressure-side contact surface 140 of the suction-side contact block 50 and the pressure-side contact block 60.

In this description, for the sake of convenience, the suction-side contact surface 110 and the pressure-side contact surface 140 are disposed in the circumferential direction (rotational direction R1) via the gap 71. However, during assembly, the suction-side contact surface 110 contacts the pressure-side contact surface 140 of the adjacent blade without any gap. However, during operation, the gap 71 is generated due to the centrifugal force and thermal expansion, and as described above, and the contact surfaces may partially contact each other due to the deformations and vibrations of the suction-side tip shroud 46 and the pressure-side tip shroud 48.

In the turbine rotor blade 28, as in the present embodiment, the recessed portions 112, 142 are provided in the entire region from the axial upper ends to the axial lower ends of the suction-side contact block 50 and the pressure-side contact block 60 on the axial downstream side, and it is possible to avoid contact of the suction-side contact surface 110 with the pressure-side contact surface 140 of the adjacent blade at the axial downstream end. That is, the contact position of the suction-side contact surface 110 with the pressure-side contact surface 140 of the tip shroud 43 can be set to a position near the base of the fin 44 on the center side with respect to the contact block ends 114, 144 of the suction-side contact block 50 and the pressure-side contact block 60. As a result, the region near the bases of the fin 44 having a high strength, of the suction-side contact block 50 and the pressure-side contact block 60, can be set to the contact region to avoid contact at the axial downstream end, thereby further improving the durability of the blades.

Specifically, as described above, the inclined surface 116 that has a large circumferential thickness and extends to the suction-side cover plate 51 and the pressure-side cover plate 61 in the circumferential direction is formed on the suction-side contact block 50 and the pressure-side contact block 60, allowing the contact blocks to contact each other at the portion having a high rigidity. In addition, by forming the fillet 120 of the fin 44 at the sites where the recessed portions 112, 142 are formed, the area of contact of the suction-side contact surface 110 with the pressure-side contact surface 140 can be made large, thereby suppressing the concentration of the load caused by contact of the adjacent blade.

As in the present embodiment, in the turbine rotor blade 28, the recessed portions 112, 142 are preferably provided over the entire regions from the radial upper ends to the radial lower ends of the suction-side contact surface 110 and the pressure-side contact surface 140 of the suction-side contact block 50 and the pressure-side contact block 60 on the axial downstream side, respectively, or, may be provided only partial radial regions of the suction-side contact block 50 and the pressure-side contact block 60 on the axial downstream side. When provided in the partial radial regions, the recessed portions are preferably provided in the regions including the respective radial outer ends. In other words, the recessed portions 112, 142 preferably include the radial outer end surface and the axial downstream end surface of the suction-side contact surface 110, and extend in the radial inward direction.

In addition, in the turbine rotor blade 28 in the present embodiment, the recessed portions 112, 142 are provided at axial downstream ends of the suction-side contact surface 110 and the pressure-side contact surface 140, but the present invention is not limited thereto. In the turbine rotor blade 28, the recessed portions may be provided at radial outer ends of the suction-side contact surface 110 and the pressure-side contact surface 140. In the turbine rotor blade 28, the recessed portions are formed at the radial outer ends of the suction-side contact surface 110 and the pressure-side contact surface 140, and thus it is possible to suppress the contact between the radial outer ends of the suction-side contact surface 110 and the pressure-side contact surface 140 each other thereby shifting the contact position from the end toward the center. The recessed portion formed at the radial outer end is preferably inclined from the outer surface of the radial inner end toward the radial outer end so as to come closer to the fin 44. As a result, high-strength regions of the suction-side contact block 50 and the pressure-side contact block 60 can be set to the contact region, further improving the durability. Thus, in the turbine rotor blade 28, the recessed portions are preferably provided over the entire regions from the axial upstream side to the axial downstream side of the radial outer ends of the suction-side contact surface 110 and the pressure-side contact surface 140 of the suction-side contact block 50 and the pressure-side contact block 60, or, may be provided only in partial axial regions of the suction-side contact block 50 and the pressure-side contact block 60 on the radial outer side. When provided in the partial axial regions, the recessed portions are preferably provided in the regions including the respective axial downstream ends.

In addition, in the turbine rotor blade 28, the recessed portions may be formed on both the axial downstream end and the radial outer end of the suction-side contact surface 110 and the pressure-side contact surface 140.

In the turbine rotor blade 28, the recessed portion 112, 142 may be formed on one of the suction-side contact block 50 and the pressure-side contact block 60. In other words, in the turbine 28, the recessed portion 112, 142 may be formed on one contact surface of the suction-side contact surface 110 and the pressure-side contact surface 140 of the suction-side contact block 50 and the pressure-side contact block 60, and the other contact surface may be an entirely flat surface. At least one of the recessed portions 112, 142 is provided, and thus the contact position of the suction-side contact surface 110 and the pressure-side contact surface 140 can be set to a position near the base of the fin 44 on the center side with respect to the contact block ends 114, 144.

In addition, in the turbine rotor blade 28, the recessed portion 112 is preferably formed at the axial downstream end of the suction-side contact block 50 of the suction-side tip shroud 46, which is away from the intermediate connecting portion 58. This facilitates easier manufacturing of the recessed portion 112.

Figure 12:
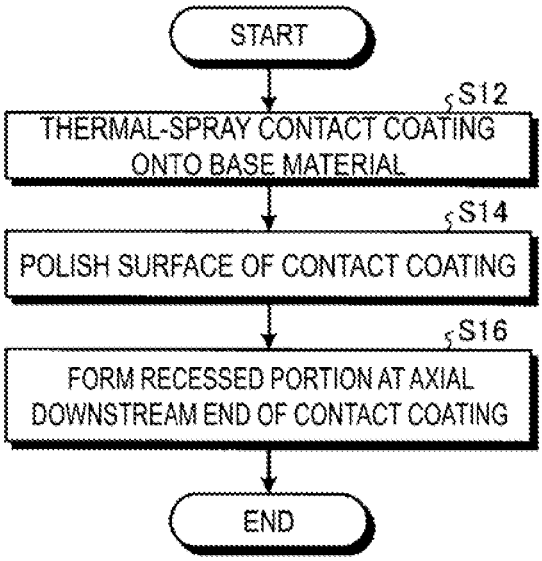
FIG. 12 is a schematic flowchart illustrating an example of a contact surface manufacturing method.

FIG. 12 is a schematic view illustrating an example of a method for manufacturing the contact surface (the suction-side contact surface 110 and the pressure-side contact surface 140). Referring also to FIGS. 6 and 9, in the turbine rotor blade, the coating 102 is formed on the surface of base material 100 in the regions corresponding to the contact surfaces of the suction-side contact block 50 and the pressure-side contact block 60 to form the contact surface. The contact surface may be manufactured by an operator through steps or using an automatic manufacturing device. The following is a description in the case where the operator performs operations.

The operator performs a step of thermal-spraying contact coating onto a region corresponding to the contact surface of the base material (step S12). Next, the operator performs a step of polishing the surface of the contact coating formed on the surface of the base material (step S14). The operator polishes the surface of the contact coating to form the flat surface 102*a*. Next, the operator performs a step of forming the recessed portion 112 on the end on the axial downstream end of the contact coating (step S16).

In the contact surface manufacturing method, by polishing the entire surface of the coating on the contact surface and then forming the recessed portion on a part of the surface, contact near the contact block end 114 having a low rigidity can be avoided and the position near the base of the fin 44 having a high rigidity can be set to the contact position, to make the contact surface of the turbine rotor blade capable of preventing damage caused by partial contact. This can manufacture the contact surface with a higher durability.

The contact surface manufacturing method described above can be used to manufacture a new turbine rotor blade contact surface, but the present invention is not limited thereto. The contact surface manufacturing method described above can also be applied to the case where coating is formed by repair of a used turbine rotor blade.

Second Embodiment

Figure 13:
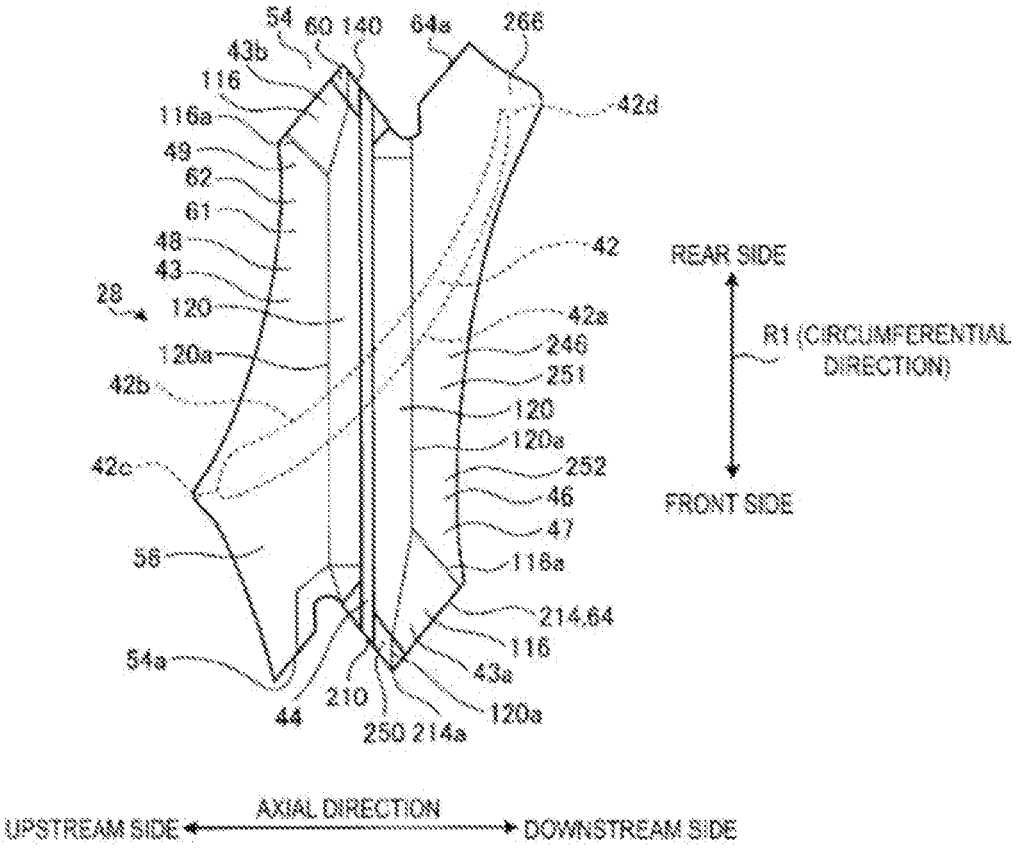
FIG. 13 is a schematic view illustrating a schematic configuration of a tip shroud of a turbine rotor blade according to a second embodiment.
Figure 14:
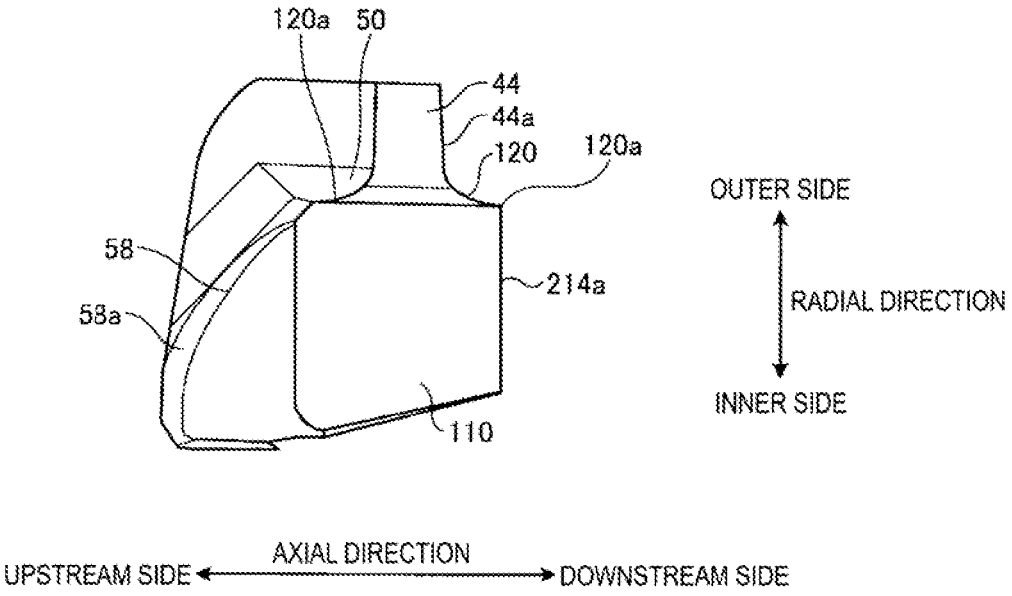
FIG. 14 is a front view illustrating a schematic configuration around the suction-side contact block in FIG. 13.

Next, a second embodiment of a turbine rotor blade will be described. FIG. 13 is a schematic view illustrating a schematic configuration of a tip shroud of the turbine rotor blade according to the second embodiment. FIG. 14 is a front view illustrating a schematic configuration of the suction-side contact block in FIG. 13. The turbine rotor blade according to the second embodiment differs from the first embodiment in the structure of the contact blocks (the suction-side contact block 50 and the pressure-side contact block 60).

As illustrated in FIG. 13 and FIG. 14, the tip shroud 43 of the turbine rotor blade 28 in the present embodiment includes a fin 44, a suction-side tip shroud 246, and a pressure-side tip shroud 48. The shape and structure of the suction-side tip shroud 246 of the tip shroud 43 in the present embodiment differs from those of the first embodiment, but the shape and structure of the fin 44 and the pressure-side tip shroud 48 are the same as those of the first embodiment.

The suction-side tip shroud 246 in the present embodiment includes a suction-side contact block 250, and a suction-side cover plate 251 that is joined to the fin 44 and extends from the fin 44 toward the axial downstream side. The fin 44, the suction-side contact block 250, and the suction-side cover plate 251 are integrally formed to be a single piece. In addition, the suction-side cover plate 251 includes a downstream suction-side cover plate 252 formed on the side of the suction-side blade surface 42*a* on the axial downstream side with respect to the fin 44 and on the side of the suction-side contact block 250 on the front edge 42*c* side, and a downstream pressure-side cover plate 266 formed on the side of the pressure-side contact block 60 on the rear edge 42*d* side. The pressure-side tip shroud 48 has the same shape and structure as those in the first embodiment, and is formed from the pressure-side contact block 60 and a pressure-side cover plate 61. Similar to the first embodiment, the pressure-side cover plate 61 is formed from an upstream suction-side cover plate 56 on the front edge 42*c* side and an upstream pressure-side cover plate 62 on the rear edge 42*d* side.

Similar to the first embodiment, the suction-side contact block 250 in the present embodiment has a suction-side contact surface (first surface) 210 that faces the front side in the rotational direction in the circumferential direction. The suction-side contact block 250 has a structure having a thickness in the direction orthogonal to the suction-side contact surface 210 on the axial downstream side with respect to the suction-side contact surface 210, extends on the opposite side to the suction-side contact surface 210 in the axial direction, and is coupled to the downstream suction-side cover plate 252. The suction-side contact block 250 has an inclined surface 116 that gradually decreases in thickness toward the axial downstream side. The suction-side contact block 250 is an end on the opposite side in the circumferential direction to of the suction-side contact surface 210, is joined to the fin 44 on the axial upstream side, and is joined to the downstream suction-side cover plate 252 of the suction-side tip shroud 246 via the inclined surface 116 on the axial downstream side.

As illustrated in FIG. 13, the contact block end 214 that faces the axial downstream side of the suction-side contact block 250 forms a part of the suction-side cover end surface 64, extends toward the axial downstream side in parallel to the downstream pressure-side cover end surface 64*a* on the rear edge 42*d* side, and is joined to the end surface of the downstream suction-side cover plate 252 on the axial downstream side. The axial position of a tip portion 214*a* of the contact block end 214 of the suction-side contact block 250 on the front side in the rotational direction matches the axial position where the fillet outer edge 120*a* of the fillet 120 on the side of the suction-side tip shroud 246 meet.

The configuration of the pressure-side contact surface 140 and the pressure-side contact block 60 on the axial upstream side with respect to the fin 44, and the inclined surface 116 extending from the pressure-side contact block 60 toward the front edge 42*c*, and the pressure-side cover plate 61 (the upstream pressure-side cover plate 62) in the present embodiment are similar to those of the first embodiment.

The suction-side contact block 250 in the present embodiment differs from the contact block in the first embodiment illustrated in FIGS. 6 and 8. That is, as described above, the end surface of the suction-side contact block 250 on the axial downstream side is an end surface that forms the contact block end 214 and extends from the tip portion 214*a* of the contact block end 214 on the axial upstream side toward the axial downstream side in parallel to the downstream pressure-side cover end surface 64*a* on the rear edge 42*d* side. In other words, when the shape of the suction-side contact surface 210 in the present embodiment is compared with the shape of the suction-side contact surface 110 in the first embodiment, the axial position of the tip portion 214*a* in the present embodiment differs from the axial position of a tip portion 114*a* in the first embodiment. The tip portion 214*a* in the present embodiment coincides with the axial position of the fillet outer edge 120*a* of the fin 44 on the side of the suction-side tip shroud 46. On the other hand, the axial position of the tip portion 114*a* in the first embodiment is formed on the axial downstream side with respect to the axial position of the fillet outer edge 120*a* of the fin 44 on the side of the suction-side tip shroud 46, and the recessed portion 112 is formed in the range from the fillet outer edge 120*a* to the contact block end 114.

The contact block end 214 of the suction-side contact block 250 in the present embodiment is formed simultaneously together with the blade body 42 and the tip shroud 43 in the casting process of the turbine rotor blade 28.

The material and forming method of the coating 102 applied to the suction-side contact surface 210 of the suction-side contact block 250 in the present embodiment are the same as the material and forming method in the first embodiment.

However, the coating forming method in the present embodiment differs from the contact surface manufacturing method in the first embodiment illustrated in FIG. 12 in that the step of forming the recessed portion 112 in step 16 is omitted. In other words, in the present embodiment, as described above, the contact block end 214 of the suction-side contact block 250 is formed in the casting process of the turbine rotor blade 28 as an end originating from the tip portion 214*a* located at the fillet outer edge 120*a* of the fin 44 on the side of the suction-side tip shroud 46. Accordingly, the suction-side contact surface 110 in the present embodiment includes no portion where the recessed portion 112 in the first embodiment is formed. In the present embodiment, the axial position of the contact block end 214 of the suction-side contact block 250 matches the position of the high-rigidity base of the fin 44. Thus, even when partial contact with the pressure-side contact surface 140 of the adjacent blade occurs, the pressure-side contact surface contacts the suction-side contact surface 210 near the high-rigidity base of the fin 44 and thus, there is no possibility that the suction-side contact surface 210 is damaged, which improves the reliability of the blade.

In addition, according to the contact surface manufacturing method in the present embodiment, unlike the contact surface manufacturing method in the first embodiment, the step of forming the recessed portion 112 illustrated in FIG. 12 (step S16) can be omitted to shorten the manufacturing process and reduce manufacturing costs.

According to the embodiment of the present invention, even when partial contact with the contact surface of the adjacent blade occurs, the contact is made at the position near the high-rigidity base of the fin 44 of the contact surface, suppressing damage to the contact surface.

REFERENCE SIGNS LIST

11 Compressor
12 Combustor
13 Turbine
27 Vane
28 Rotor blade (turbine rotor blade)
32 Rotor (rotating shaft)
41 Blade root
42 Blade body
42*a* Suction surface (suction-side blade surface)
42*b* Pressure surface (pressure-side blade surface)
42*c* Front edge
42*d* Rear edge
43 Tip shroud
43*a* Front edge end
43*b* Rear edge end
44 Seal fin (fin)
44*a* End surface
46 Suction-side tip shroud
47 Suction-side end region
49 Pressure-side end region
48 Pressure-side tip shroud
50, 250 Suction-side contact block
60 Pressure-side contact block
51, 251 Suction-side cover plate
52, 252 Downstream suction-side cover plate
56 Upstream suction-side cover plate
54 Pressure-side cover end surface
54*a* Upstream suction-side cover end surface
64 Suction-side cover end surface
64*a* Downstream pressure-side cover end surface
58, 68 Intermediate connecting portion
61 Pressure-side cover plate
62 Upstream pressure-side cover plate
66, 266 Downstream pressure-side cover plate
71 Gap
100 Base material
102 Coating
102*a* Flat surface
110, 210 Suction-side contact surface (first surface)
140 Pressure-side contact surface (second surface)
112, 142 Recessed portion
112*a*, 142*a* Recessed portion inclined surface
114, 144, 214 Contact block end
116 Inclined surface
116*a* Inclined surface outer edge
120 Fillet
120*a* Fillet outer edge

The invention claimed is:

1. A turbine rotor blade comprising:

a blade body including a pressure surface and a suction surface; and a tip shroud provided on a tip portion of the blade body, the tip shroud being inclined outward in a radial direction from the pressure surface to the suction surface in an axial direction, wherein:

the tip shroud includes a fin disposed at a center portion in a circumferential direction, the fin extending outward in the radial direction, a pressure-side tip shroud on the pressure surface side, and a suction-side tip shroud on the suction surface side, the suction-side tip shroud includes a suction-side contact block at a front edge end of the tip shroud, the pressure-side tip shroud includes a pressure-side contact block at a rear edge end of the tip shroud, the suction-side contact block includes a first surface facing in the circumferential direction, the pressure-side contact block includes a second surface facing in a direction opposite to the circumferential direction which the first surface is facing, and a recessed portion is formed on at least an axial downstream end or a radial outer end of at least one of the first surface or the second surface, wherein the fin is coupled to the suction-side contact block or the pressure-side contact block or the cover plate via a fillet, and an axial upstream end of the recessed portion formed at the axial downstream end along a gap formed between the first surface and the second surface is formed between a position of an outer edge on the axial downstream side and a position of an outer edge on the axial upstream side of the fillet.

2. The turbine rotor blade according to claim 1, wherein the first surface and the second surface of the adjacent blade in the circumferential direction are disposed so as to face each other.

3. The turbine rotor blade according to claim 1, wherein:

the suction-side tip shroud is configured of:

the suction-side contact block; and a suction-side cover plate extending toward the axial downstream side of the fin from an edge of an axial inner circumferential surface of the tip shroud along the axial inner circumferential surface of the tip shroud so as to be away from the first surface, the pressure-side tip shroud is configured of:

the pressure-side contact block; and a pressure-side cover plate extending toward the axial upstream side of the fin from the edge of the axial inner circumferential surface of the tip shroud along the axial inner circumferential surface of the tip shroud so as to be away from the second surface; and in a circumferential sectional view enclosing the first surface or the second surface, the suction-side tip shroud extends toward the axial downstream side, and is inclined toward the radial outer side, and the pressure-side tip shroud extends toward the axial upstream side, and is inclined toward the radial inner side.

4. The turbine rotor blade according to claim 1, wherein:

when viewing a gap formed between the first surface and the second surface, an angle formed between the first surface and an inner circumferential surface facing a radial inner side of the suction-side tip shroud in a clockwise direction from the first surface is less than 90 degrees; and an angle formed between the second surface and an inner circumferential surface facing a radial inner side of the pressure-side tip shroud in a counterclockwise direction from the second surface is larger than 90 degrees.

5. The turbine rotor blade according to claim 1, wherein the recessed portion formed on the axial downstream end of the first surface or the second surface along a gap formed between the first surface and the second surface includes at least a radial outer end surface and an axial downstream end surface of the first surface or the second surface, and extends toward the radial inner side.

6. The turbine rotor blade according to claim 1, wherein: the tip shroud includes:

a suction-side end region provided at a front edge end, the suction-side end region having a fixed end on the blade body and extending from the fixed end to a suction-side cover end surface that is a free end on a front side in a rotational direction; and a pressure-side end region provided at a rear edge end, the pressure-side end region having a fixed end on the blade body and extending from the fixed end to a pressure-side cover end surface that is a free end on a rear side in the rotational direction.

7. The turbine rotor blade according to claim 1, wherein the recessed portion formed on the axial downstream end of the first surface or the second surface is inclined from an outer surface of an axial upstream end of the recessed portion toward the axial downstream end so as to retract from a contact surface in the circumferential direction.

8. The turbine rotor blade according to claim 1, wherein the recessed portion formed on the radial outer side of the first surface or the second surface is inclined from an outer surface of a radial inner end of the recessed portion toward the radial outer end so as to come closer to the fin.

9. The turbine rotor blade according to claim 1, wherein:

the suction-side contact block including the first surface is joined to the fin on an axial upstream side of the suction-side contact block, and is joined to a suction-side cover plate on an axial downstream side via an inclined surface; and the pressure-side contact block including the second surface is joined to the fin on an axial downstream side of the pressure-side contact block, and is joined to an pressure-side cover plate on an axial upstream side via an inclined surface.

10. A turbo machine comprising the turbine rotor blade according to claim 1.

11. A method for manufacturing a contact surface of a turbine rotor blade, the turbine rotor blade comprising:

a blade body including a pressure surface and a suction surface; and a tip shroud provided on a tip portion of the blade body, the tip shroud being inclined outward in a radial direction from the pressure surface to the suction surface in an axial direction, wherein:

the tip shroud includes a fin disposed at a center portion in a circumferential direction, the fin extending outward in the radial direction, a pressure-side tip shroud on the pressure surface side, and a suction-side tip shroud on the suction surface side, the suction-side tip shroud includes a suction-side contact block at a front edge end of the tip shroud, the pressure-side tip shroud includes a pressure-side contact block at a rear edge end of the tip shroud, the suction-side contact block includes a first surface facing in the circumferential direction, the pressure-side contact block includes a second surface facing in a direction opposite to the circumferential direction which the first surface is facing, a recessed portion is formed on at least an axial downstream end or a radial outer end of at least one of the first surface or the second surface, and the contact surface is at least one of the first surface or the second surface, the method comprising:

forming a coating on a surface of a base material, the surface serving as the contact surface of the turbine rotor blade;

polishing and flattening a surface of the formed coating; and polishing at least an axial downstream end or a radial outer end of the coating to form the recessed portion.

12. A turbine rotor blade comprising:

a blade body including a pressure surface and a suction surface; and a tip shroud provided on a tip portion of the blade body, the tip shroud being inclined outward in a radial direction from the pressure surface to the suction surface in an axial direction, wherein:

the tip shroud includes a fin disposed at a center portion in a circumferential direction, the fin extending outward in the radial direction, a pressure-side tip shroud on the pressure surface side, and a suction-side tip shroud on the suction surface side, the suction-side tip shroud includes a suction-side contact block at a front edge end of the tip shroud, the pressure-side tip shroud includes a pressure-side contact block at a rear edge end of the tip shroud, the suction-side contact block includes a first surface facing in the circumferential direction, the pressure-side contact block includes a second surface facing in a direction opposite to the circumferential direction which the first surface is facing, a recessed portion is formed on at least an axial downstream end or a radial outer end of at least one of the first surface or the second surface, the suction-side contact block including the first surface is joined to the fin on an axial upstream side of the suction-side contact block, and is joined to a suction-side cover plate on an axial downstream side via an inclined surface, and the pressure-side contact block including the second surface is joined to the fin on an axial downstream side of the pressure-side contact block, and is joined to an pressure-side cover plate on an axial upstream side via an inclined surface.

13. The turbine rotor blade according to claim 12, wherein the first surface and the second surface of the adjacent blade in the circumferential direction are disposed so as to face each other.

14. The turbine rotor blade according to claim 12, wherein:

the suction-side tip shroud is configured of:

the suction-side contact block; and a suction-side cover plate extending toward the axial downstream side of the fin from an edge of an axial inner circumferential surface of the tip shroud along the axial inner circumferential surface of the tip shroud so as to be away from the first surface, the pressure-side tip shroud is configured of:

the pressure-side contact block; and a pressure-side cover plate extending toward the axial upstream side of the fin from the edge of the axial inner circumferential surface of the tip shroud along the axial inner circumferential surface of the tip shroud so as to be away from the second surface; and in a circumferential sectional view enclosing the first surface or the second surface, the suction-side tip shroud extends toward the axial downstream side, and is inclined toward the radial outer side, and the pressure-side tip shroud extends toward the axial upstream side, and is inclined toward the radial inner side.

15. The turbine rotor blade according to claim 12, wherein:

when viewing a gap formed between the first surface and the second surface, an angle formed between the first surface and an inner circumferential surface facing a radial inner side of the suction-side tip shroud in a clockwise direction from the first surface is less than 90 degrees; and an angle formed between the second surface and an inner circumferential surface facing a radial inner side of the pressure-side tip shroud in a counterclockwise direction from the second surface is larger than 90 degrees.

16. The turbine rotor blade according to claim 12, wherein the recessed portion formed on the axial downstream end of the first surface or the second surface along a gap formed between the first surface and the second surface includes at least a radial outer end surface and an axial downstream end surface of the first surface or the second surface, and extends toward the radial inner side.

17. The turbine rotor blade according to claim 12, wherein the fin is coupled to the suction-side contact block or the pressure-side contact block or the cover plate via a fillet, and an axial upstream end of the recessed portion formed at the axial downstream end along a gap formed between the first surface and the second surface is formed between a position of an outer edge on the axial downstream side and a position of an outer edge on the axial upstream side of the fillet.

18. The turbine rotor blade according to claim 12, wherein:

the tip shroud includes:

a suction-side end region provided at a front edge end, the suction-side end region having a fixed end on the blade body and extending from the fixed end to a suction-side cover end surface that is a free end on a front side in a rotational direction; and a pressure-side end region provided at a rear edge end, the pressure-side end region having a fixed end on the blade body and extending from the fixed end to a pressure-side cover end surface that is a free end on a rear side in the rotational direction.

19. The turbine rotor blade according to claim 12, wherein the recessed portion formed on the axial downstream end of the first surface or the second surface is inclined from an outer surface of an axial upstream end of the recessed portion toward the axial downstream end so as to retract from a contact surface in the circumferential direction.

20. The turbine rotor blade according to claim 1, wherein the recessed portion formed on the radial outer side of the first surface or the second surface is inclined from an outer surface of a radial inner end of the recessed portion toward the radial outer end so as to come closer to the fin.

21. A turbo machine comprising the turbine rotor blade according to claim 12.

* * * * *